US010301909B2

(12) United States Patent
McCoy et al.

(10) Patent No.: US 10,301,909 B2
(45) **Date of Patent: *May 28, 2019**

(54) SELECTIVELY DEGRADABLE PASSAGE RESTRICTION

(71) Applicants: Matthew T. McCoy, Richmond, TX (US); Matthew D. Solfronk, Katy, TX (US); Jack D. Farmer, Dickinson, TX (US); William A. Burton, Houston, TX (US); James G. King, Kingwood, TX (US); Jason J. Barnard, Katy, TX (US); Edward J. O'Malley, Houston, TX (US)

(72) Inventors: Matthew T. McCoy, Richmond, TX (US); Matthew D. Solfronk, Katy, TX (US); Jack D. Farmer, Dickinson, TX (US); William A. Burton, Houston, TX (US); James G. King, Kingwood, TX (US); Jason J. Barnard, Katy, TX (US); Edward J. O'Malley, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1077 days.

This patent is subject to a terminal disclaimer.

(21) Appl. No.: 14/453,792

(22) Filed: Aug. 7, 2014

(65) Prior Publication Data

US 2014/0345877 A1 Nov. 27, 2014

Related U.S. Application Data

(62) Division of application No. 13/211,817, filed on Aug. 17, 2011, now Pat. No. 9,033,055.

(51) Int. Cl.

| | |
|---|---|
| ***E21B 34/06*** | (2006.01) |
| ***E21B 34/14*** | (2006.01) |
| *E21B 34/00* | (2006.01) |

(52) U.S. Cl.

CPC ..... *E21B 34/14* (2013.01); *E21B 34/063* (2013.01); *E21B 2034/007* (2013.01)

(58) Field of Classification Search

CPC ..... E21B 34/14

See application file for complete search history.

(56) References Cited

U.S. PATENT DOCUMENTS

| | | | |
|---|---|---|---|
| 1,468,905 | A | 9/1923 | Herman |
| 1,558,066 | A | 10/1925 | Veazey et al. |

(Continued)

FOREIGN PATENT DOCUMENTS

| | | | |
|---|---|---|---|
| CA | 2783241 | A1 | 6/2011 |
| CA | 2783346 | A1 | 6/2011 |

(Continued)

OTHER PUBLICATIONS

"Declaration of Karl T. Hartwig in Support of Petitioner Pursuant to 37 C.F.R. § 42.120", executed on Nov. 21, 2016 in support of U.S. Pat. No. 8,573,295, 52 pages.

(Continued)

*Primary Examiner* — Robert E Fuller
(74) *Attorney, Agent, or Firm* — Cantor Colburn LLP

(57) ABSTRACT

An actuation system and method, the system including a tubular having a passage, and an assembly disposed with the tubular. The assembly includes a degradable restriction, the restriction only partially blocking the passage prior to being degraded. The assembly is configured to receive and prevent further movement of a restrictor through the tubular prior to (Continued)

the restriction being degraded. The assembly is further configured to release the restrictor when the restriction is degraded.

20 Claims, 7 Drawing Sheets

(56) References Cited

U.S. PATENT DOCUMENTS

| | | | |
|---|---|---|---|
| 1,880,614 | A | 10/1932 | Wetherill |
| 2,011,613 | A | 8/1935 | Brown et al. |
| 2,094,578 | A | 10/1937 | Blumenthal et al. |
| 2,189,697 | A | 2/1940 | Baker |
| 2,222,233 | A | 11/1940 | Mize |
| 2,225,143 | A | 12/1940 | Baker et al. |
| 2,238,895 | A | 4/1941 | Gage |
| 2,261,292 | A | 11/1941 | Salnikov |
| 2,294,648 | A | 9/1942 | Ansel |
| 2,301,624 | A | 11/1942 | Holt |
| 2,352,993 | A | 7/1944 | Albertson |
| 2,394,843 | A | 2/1946 | Cooke et al. |
| 2,672,199 | A | 3/1954 | McKenna |
| 2,753,941 | A | 7/1956 | Hebard et al. |
| 2,754,910 | A | 7/1956 | Derrick et al. |
| 2,933,136 | A | 4/1960 | Ayers et al. |
| 2,983,634 | A | 5/1961 | Budininkas et al. |
| 3,057,405 | A | 10/1962 | Mallinger |
| 3,066,391 | A | 12/1962 | Vordahl |
| 3,106,959 | A | 10/1963 | Huitt et al. |
| 3,142,338 | A | 7/1964 | Brown |
| 3,152,009 | A | 10/1964 | DeLong |
| 3,180,728 | A | 4/1965 | Keir et al. |
| 3,180,778 | A | 4/1965 | Stilli et al. |
| 3,196,949 | A | 7/1965 | Thomas |
| 3,226,314 | A | 12/1965 | Wellington et al. |
| 3,242,988 | A | 3/1966 | McGuire et al. |
| 3,298,440 | A | 1/1967 | Current |
| 3,316,748 | A | 5/1967 | Lang et al. |
| 3,326,291 | A | 6/1967 | Zandmer et al. |
| 3,343,537 | A | 9/1967 | Graham |
| 3,347,317 | A | 10/1967 | Zandemer |
| 3,347,714 | A | 10/1967 | Broverman et al. |
| 3,385,696 | A | 5/1968 | Hitchcock et al. |
| 3,390,724 | A | 7/1968 | Caldwell |
| 3,395,758 | A | 8/1968 | Kelly et al. |
| 3,406,101 | A | 10/1968 | Kilpatrick |
| 3,416,918 | A | 12/1968 | Henry |
| 3,434,539 | A | 3/1969 | Merritt |
| 3,445,148 | A | 5/1969 | Harris et al. |
| 3,465,181 | A | 9/1969 | Colby et al. |
| 3,489,218 | A | 1/1970 | Means |
| 3,513,230 | A | 5/1970 | Rhees et al. |
| 3,600,163 | A | 8/1971 | Badia, et al. |
| 3,602,305 | A | 8/1971 | Kisling |
| 3,637,446 | A | 1/1972 | Elliott et al. |
| 3,645,331 | A | 2/1972 | Maurer et al. |
| 3,660,049 | A | 5/1972 | Benjamin |
| 3,765,484 | A | 10/1973 | Hamby, Jr. et al. |
| 3,768,563 | A | 10/1973 | Blount |
| 3,775,823 | A | 12/1973 | Adolph et al. |
| 3,816,080 | A | 6/1974 | Bomford et al. |
| 3,878,889 | A | 4/1975 | Seabourn |
| 3,894,850 | A | 7/1975 | Kovalchuk et al. |
| 3,924,677 | A | 12/1975 | Prenner et al. |
| 3,957,483 | A | 5/1976 | Suzuki |
| 4,010,583 | A | 3/1977 | Highberg |
| 4,039,717 | A | 8/1977 | Titus |
| 4,050,529 | A | 9/1977 | Tagirov et al. |
| 4,157,732 | A | 6/1979 | Fonner |
| 4,248,307 | A | 2/1981 | Silberman et al. |
| 4,284,137 | A | 8/1981 | Taylor |
| 4,292,377 | A | 9/1981 | Petersen et al. |
| 4,368,788 | A | 1/1983 | Drake |
| 4,372,384 | A | 2/1983 | Kinney |
| 4,373,584 | A | 2/1983 | Silberman et al. |
| 4,373,952 | A | 2/1983 | Parent |
| 4,374,543 | A | 2/1983 | Richardson |
| 4,384,616 | A | 5/1983 | Dellinger |
| 4,395,440 | A | 7/1983 | Abe et al. |
| 4,399,871 | A | 8/1983 | Adkins et al. |
| 4,407,368 | A | 10/1983 | Erbstoesser |
| 4,422,508 | A | 12/1983 | Rutledge, Jr. et al. |
| 4,450,136 | A | 5/1984 | Dudek et al. |
| 4,452,311 | A | 6/1984 | Speegle et al. |
| 4,475,729 | A | 10/1984 | Costigan |
| 4,498,543 | A | 2/1985 | Pye et al. |
| 4,499,048 | A | 2/1985 | Hanejko |
| 4,499,049 | A | 2/1985 | Hanejko |
| 4,524,825 | A | 6/1985 | Fore |
| 4,526,840 | A | 7/1985 | Jerabek |
| 4,534,414 | A | 8/1985 | Pringle |
| 4,539,175 | A | 9/1985 | Lichti et al. |
| 4,554,986 | A | 11/1985 | Jones |
| 4,619,699 | A | 10/1986 | Petkovic-Luton et al. |
| 4,640,354 | A | 2/1987 | Boisson |
| 4,648,901 | A | 3/1987 | Murray et al. |
| 4,664,962 | A | 5/1987 | Desmarais, Jr. |
| 4,668,470 | A | 5/1987 | Gilman et al. |
| 4,673,549 | A | 6/1987 | Ecer |
| 4,674,572 | A | 6/1987 | Gallus |
| 4,678,037 | A | 7/1987 | Smith |
| 4,681,133 | A | 7/1987 | Weston |
| 4,688,641 | A | 8/1987 | Knieriemen |
| 4,690,796 | A | 9/1987 | Paliwal |
| 4,693,863 | A | 9/1987 | Del Corso et al. |
| 4,703,807 | A | 11/1987 | Weston |
| 4,706,753 | A | 11/1987 | Ohkochi et al. |
| 4,708,202 | A | 11/1987 | Sukup et al. |
| 4,708,208 | A | 11/1987 | Halbardier |
| 4,709,761 | A | 12/1987 | Setterberg, Jr. |
| 4,714,116 | A | 12/1987 | Brunner |
| 4,716,964 | A | 1/1988 | Erbstoesser et al. |
| 4,719,971 | A | 1/1988 | Owens |
| 4,721,159 | A | 1/1988 | Ohkochi et al. |
| 4,738,599 | A | 4/1988 | Shilling |
| 4,741,973 | A | 5/1988 | Condit et al. |
| 4,768,588 | A | 9/1988 | Kupsa |
| 4,775,598 | A | 10/1988 | Jaeckel |
| 4,784,226 | A | 11/1988 | Wyatt |
| 4,805,699 | A | 2/1989 | Halbardier |
| 4,817,725 | A | 4/1989 | Jenkins |
| 4,834,184 | A | 5/1989 | Streich et al. |
| H635 | H | 6/1989 | Johnson et al. |
| 4,850,432 | A | 7/1989 | Porter et al. |
| 4,853,056 | A | 8/1989 | Hoffman |
| 4,869,324 | A | 9/1989 | Holder |
| 4,869,325 | A | 9/1989 | Halbardier |
| 4,880,059 | A | 11/1989 | Brandell et al. |
| 4,889,187 | A | 12/1989 | Terrell et al. |
| 4,890,675 | A | 1/1990 | Dew |
| 4,901,794 | A | 2/1990 | Baugh et al. |
| 4,909,320 | A | 3/1990 | Hebert et al. |
| 4,917,966 | A | 4/1990 | Wilde et al. |
| 4,921,664 | A | 5/1990 | Couper |
| 4,929,415 | A | 5/1990 | Okazaki |
| 4,932,474 | A | 6/1990 | Schroeder, Jr. et al. |
| 4,934,459 | A | 6/1990 | Baugh et al. |
| 4,938,309 | A | 7/1990 | Emdy |
| 4,938,809 | A | 7/1990 | Das et al. |
| 4,944,351 | A | 7/1990 | Eriksen et al. |
| 4,949,788 | A | 8/1990 | Szarka et al. |
| 4,952,902 | A | 8/1990 | Kawaguchi et al. |
| 4,975,412 | A | 12/1990 | Okazaki et al. |
| 4,977,958 | A | 12/1990 | Miller |
| 4,981,177 | A | 1/1991 | Carmody et al. |
| 4,986,361 | A | 1/1991 | Mueller et al. |
| 4,997,622 | A | 3/1991 | Regazzoni et al. |
| 5,006,044 | A | 4/1991 | Walker, Sr. et al. |
| 5,010,955 | A | 4/1991 | Springer |
| 5,036,921 | A | 8/1991 | Pittard et al. |
| 5,048,611 | A | 9/1991 | Cochran |
| 5,049,165 | A | 9/1991 | Tselesin |
| 5,061,323 | A | 10/1991 | DeLuccia |
| 5,063,775 | A | 11/1991 | Walker, Sr. et al. |

(56) References Cited

U.S. PATENT DOCUMENTS 5,073,207 A 12/1991 Faure et al.
5,074,361 A 12/1991 Brisco et al.
5,076,869 A 12/1991 Bourell et al.
5,084,088 A 1/1992 Okazaki
5,087,304 A 2/1992 Chang et al.
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,171,734 A 12/1992 Sanjurjo et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,240,742 A 8/1993 Johnson et al.
5,252,365 A 10/1993 White
5,253,714 A 10/1993 Davis et al.
5,271,468 A 12/1993 Streich et al.
5,273,569 A 12/1993 Gilman et al.
5,282,509 A 2/1994 Schurr, III
5,285,798 A 2/1994 Banerjee et al.
5,292,478 A 3/1994 Scorey
5,293,940 A 3/1994 Hromas et al.
5,304,260 A 4/1994 Aikawa et al.
5,304,588 A 4/1994 Boysen et al.
5,309,874 A 5/1994 Willermet et al.
5,310,000 A 5/1994 Arterbury et al.
5,316,598 A 5/1994 Chang et al.
5,318,746 A 6/1994 Lashmore
5,352,522 A 10/1994 Kugimiya et al.
5,380,473 A 1/1995 Bogue et al.
5,387,380 A 2/1995 Cima et al.
5,392,860 A 2/1995 Ross
5,394,236 A 2/1995 Murnick
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,479,986 A 1/1996 Gano et al.
5,494,538 A 2/1996 Kirillov et al.
5,506,055 A 4/1996 Dorfman et al.
5,507,439 A 4/1996 Story
5,511,620 A 4/1996 Baugh et al.
5,524,699 A 6/1996 Cook
5,526,880 A 6/1996 Jordan, Jr. et al.
5,526,881 A 6/1996 Martin et al.
5,529,746 A 6/1996 Knoss et al.
5,531,735 A 7/1996 Thompson
5,533,573 A 7/1996 Jordan, Jr. et al.
5,536,485 A 7/1996 Kume et al.
5,558,153 A 9/1996 Holcombe et al.
5,601,924 A 2/1997 Beane
5,607,017 A 3/1997 Owens et al.
5,623,993 A 4/1997 Van Buskirk et al.
5,623,994 A 4/1997 Robinson
5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,722,033 A 2/1998 Carden
5,728,195 A 3/1998 Eastman et al.
5,765,639 A 6/1998 Muth
5,772,735 A 6/1998 Sehgal et al.
5,782,305 A 7/1998 Hicks
5,797,454 A 8/1998 Hipp
5,820,608 A 10/1998 Luzio et al.
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth
5,941,309 A 8/1999 Appleton
5,960,881 A 10/1999 Allamon et al.
5,964,965 A 10/1999 Schulz et al.
5,985,466 A 11/1999 Atarashi et al.
5,988,287 A 11/1999 Jordan, Jr. et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,030,637 A 2/2000 Whitehead
6,032,735 A 3/2000 Echols
6,033,622 A 3/2000 Maruyama
6,036,777 A 3/2000 Sachs
6,040,087 A 3/2000 Canon
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb
6,167,970 B1 1/2001 Stout et al.
6,170,583 B1 1/2001 Boyce
6,171,359 B1 1/2001 Levinski et al.
6,173,779 B1 1/2001 Smith
6,176,323 B1 1/2001 Weirich et al.
6,189,616 B1 2/2001 Gano et al.
6,189,618 B1 2/2001 Beeman et al.
6,213,202 B1 4/2001 Read, Jr.
6,220,349 B1 4/2001 Vargus et al.
6,220,350 B1 4/2001 Brothers et al.
6,220,357 B1 4/2001 Carmichael et al.
6,228,904 B1 5/2001 Yadav et al.
6,237,688 B1 5/2001 Burleson et al.
6,238,280 B1 5/2001 Ritt et al.
6,241,021 B1 6/2001 Bowling
6,248,399 B1 6/2001 Hehmann
6,250,392 B1 6/2001 Muth
6,261,432 B1 7/2001 Huber et al.
6,265,205 B1 7/2001 Hitchens et al.
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,332 B1 9/2001 Bolz et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.

(56) References Cited

U.S. PATENT DOCUMENTS

| | | | |
|---|---|---|---|
| 6,325,148 | B1 | 12/2001 | Trahan et al. |
| 6,328,110 | B1 | 12/2001 | Joubert |
| 6,341,653 | B1 | 1/2002 | Firmaniuk et al. |
| 6,341,747 | B1 | 1/2002 | Schmidt et al. |
| 6,349,766 | B1 | 2/2002 | Bussear et al. |
| 6,354,372 | B1 | 3/2002 | Carisella et al. |
| 6,354,379 | B2 | 3/2002 | Miszewski et al. |
| 6,357,322 | B1 | 3/2002 | Dolan et al. |
| 6,357,332 | B1 | 3/2002 | Vecchio |
| 6,371,206 | B1 | 4/2002 | Mills |
| 6,372,346 | B1 | 4/2002 | Toth |
| 6,382,244 | B2 | 5/2002 | Vann |
| 6,390,195 | B1 | 5/2002 | Nguyen et al. |
| 6,390,200 | B1 | 5/2002 | Allamon et al. |
| 6,394,180 | B1 | 5/2002 | Berscheidt et al. |
| 6,394,185 | B1 | 5/2002 | Constien |
| 6,397,950 | B1 | 6/2002 | Streich et al. |
| 6,401,547 | B1 | 6/2002 | Hatfield et al. |
| 6,403,210 | B1 | 6/2002 | Stuivinga et al. |
| 6,408,946 | B1 | 6/2002 | Marshall et al. |
| 6,419,023 | B1 | 7/2002 | George et al. |
| 6,439,313 | B1 | 8/2002 | Thomeer et al. |
| 6,446,717 | B1 | 9/2002 | White et al. |
| 6,457,525 | B1 | 10/2002 | Scott |
| 6,467,546 | B2 | 10/2002 | Allamon et al. |
| 6,470,965 | B1 | 10/2002 | Winzer |
| 6,491,097 | B1 | 12/2002 | Oneal et al. |
| 6,491,116 | B2 | 12/2002 | Berscheidt et al. |
| 6,513,598 | B2 | 2/2003 | Moore et al. |
| 6,513,600 | B2 | 2/2003 | Ross |
| 6,540,033 | B1 | 4/2003 | Sullivan et al. |
| 6,543,543 | B2 | 4/2003 | Muth |
| 6,561,275 | B2 | 5/2003 | Glass et al. |
| 6,581,681 | B1 | 6/2003 | Zimmerman et al. |
| 6,588,507 | B2 | 7/2003 | Dusterhoft et al. |
| 6,591,915 | B2 | 7/2003 | Burris et al. |
| 6,601,648 | B2 | 8/2003 | Ebinger |
| 6,601,650 | B2 | 8/2003 | Sundararajan |
| 6,609,569 | B2 | 8/2003 | Howlett et al. |
| 6,612,826 | B1 | 9/2003 | Bauer et al. |
| 6,613,383 | B1 | 9/2003 | George et al. |
| 6,619,400 | B2 | 9/2003 | Brunet |
| 6,634,428 | B2 | 10/2003 | Krauss et al. |
| 6,662,886 | B2 | 12/2003 | Russell |
| 6,675,889 | B1 | 1/2004 | Mullins et al. |
| 6,699,305 | B2 | 3/2004 | Myrick |
| 6,712,153 | B2 | 3/2004 | Turley et al. |
| 6,712,797 | B1 | 3/2004 | Southern, Jr. |
| 6,713,177 | B2 | 3/2004 | George et al. |
| 6,715,541 | B2 | 4/2004 | Pedersen et al. |
| 6,719,051 | B2 | 4/2004 | Hailey, Jr. et al. |
| 6,755,249 | B2 | 6/2004 | Robison et al. |
| 6,769,491 | B2 | 8/2004 | Zimmerman et al. |
| 6,776,228 | B2 | 8/2004 | Pedersen et al. |
| 6,779,599 | B2 | 8/2004 | Mullins et al. |
| 6,799,638 | B2 | 10/2004 | Butterfield, Jr. |
| 6,810,960 | B2 | 11/2004 | Pia |
| 6,817,414 | B2 | 11/2004 | Lee |
| 6,831,044 | B2 | 12/2004 | Constien |
| 6,883,611 | B2 | 4/2005 | Smith et al. |
| 6,887,297 | B2 | 5/2005 | Winter et al. |
| 6,896,049 | B2 | 5/2005 | Moyes |
| 6,896,061 | B2 | 5/2005 | Hriscu et al. |
| 6,899,176 | B2 | 5/2005 | Hailey, Jr. et al. |
| 6,899,777 | B2 | 5/2005 | Vaidyanathan et al. |
| 6,908,516 | B2 | 6/2005 | Hehmann et al. |
| 6,913,827 | B2 | 7/2005 | George et al. |
| 6,926,086 | B2 | 8/2005 | Patterson et al. |
| 6,932,159 | B2 | 8/2005 | Hovem |
| 6,939,388 | B2 | 9/2005 | Angeliu |
| 6,945,331 | B2 | 9/2005 | Patel |
| 6,951,331 | B2 | 10/2005 | Haughom et al. |
| 6,959,759 | B2 | 11/2005 | Doane et al. |
| 6,973,970 | B2 | 12/2005 | Johnston et al. |
| 6,973,973 | B2 | 12/2005 | Howard et al. |
| 6,983,796 | B2 | 1/2006 | Bayne et al. |
| 6,986,390 | B2 | 1/2006 | Doane et al. |
| 7,013,989 | B2 | 3/2006 | Hammond et al. |
| 7,013,998 | B2 | 3/2006 | Ray et al. |
| 7,017,664 | B2 | 3/2006 | Walker et al. |
| 7,017,677 | B2 | 3/2006 | Keshavan et al. |
| 7,021,389 | B2 | 4/2006 | Bishop et al. |
| 7,025,146 | B2 | 4/2006 | King et al. |
| 7,028,778 | B2 | 4/2006 | Krywitsky |
| 7,044,230 | B2 | 5/2006 | Starr et al. |
| 7,048,812 | B2 | 5/2006 | Bettles et al. |
| 7,049,272 | B2 | 5/2006 | Sinclair et al. |
| 7,051,805 | B2 | 5/2006 | Doane et al. |
| 7,059,410 | B2 | 6/2006 | Bousche et al. |
| 7,063,748 | B2 | 6/2006 | Talton |
| 7,090,027 | B1 | 8/2006 | Williams |
| 7,093,664 | B2 | 8/2006 | Todd et al. |
| 7,096,945 | B2 | 8/2006 | Richards et al. |
| 7,096,946 | B2 | 8/2006 | Jasser et al. |
| 7,097,807 | B1 | 8/2006 | Meeks, III et al. |
| 7,097,906 | B2 | 8/2006 | Gardner |
| 7,108,080 | B2 | 9/2006 | Tessari et al. |
| 7,111,682 | B2 | 9/2006 | Blaisdell |
| 7,128,145 | B2 | 10/2006 | Mickey |
| 7,141,207 | B2 | 11/2006 | Jandeska, Jr. et al. |
| 7,150,326 | B2 | 12/2006 | Bishop et al. |
| 7,163,066 | B2 | 1/2007 | Lehr |
| 7,165,622 | B2 | 1/2007 | Hirth et al. |
| 7,168,494 | B2 | 1/2007 | Starr et al. |
| 7,174,963 | B2 | 2/2007 | Bertelsen |
| 7,182,135 | B2 | 2/2007 | Szarka |
| 7,188,559 | B1 | 3/2007 | Vecchio |
| 7,210,527 | B2 | 5/2007 | Walker et al. |
| 7,210,533 | B2 | 5/2007 | Starr et al. |
| 7,217,311 | B2 | 5/2007 | Hong et al. |
| 7,234,530 | B2 | 6/2007 | Gass |
| 7,250,188 | B2 | 7/2007 | Dodelet et al. |
| 7,252,162 | B2 | 8/2007 | Akinlade et al. |
| 7,255,172 | B2 | 8/2007 | Johnson |
| 7,255,178 | B2 | 8/2007 | Slup et al. |
| 7,264,060 | B2 | 9/2007 | Wills |
| 7,267,172 | B2 | 9/2007 | Hofman |
| 7,267,178 | B2 | 9/2007 | Krywitsky |
| 7,270,186 | B2 | 9/2007 | Johnson |
| 7,287,592 | B2 | 10/2007 | Surjaatmadja et al. |
| 7,311,152 | B2 | 12/2007 | Howard et al. |
| 7,316,274 | B2 | 1/2008 | Xu et al. |
| 7,320,365 | B2 | 1/2008 | Pia |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,867 | B2 | 4/2008 | Carter et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,373,978 | B2 | 5/2008 | Barry et al. |
| 7,380,600 | B2 | 6/2008 | Willberg et al. |
| 7,384,443 | B2 | 6/2008 | Mirchandani |
| 7,387,158 | B2 | 6/2008 | Murray et al. |
| 7,387,165 | B2 | 6/2008 | Lopez De Cardenas et al. |
| 7,392,841 | B2 | 7/2008 | Murray et al. |
| 7,401,648 | B2 | 7/2008 | Bennett |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,752 | B2 | 12/2008 | Dale et al. |
| 7,464,764 | B2 | 12/2008 | Xu |
| 7,472,750 | B2 | 1/2009 | Walker et al. |

(56) References Cited

U.S. PATENT DOCUMENTS

| | | | |
|---|---|---|---|
| 7,478,676 | B2 | 1/2009 | East, Jr. et al. |
| 7,503,390 | B2 | 3/2009 | Gomez |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,516,791 | B2 | 4/2009 | Bryant et al. |
| 7,527,103 | B2 | 5/2009 | Huang et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,607,476 | B2 | 10/2009 | Tom et al. |
| 7,617,871 | B2 | 11/2009 | Surjaatmadja et al. |
| 7,635,023 | B2 | 12/2009 | Goldberg et al. |
| 7,640,988 | B2 | 1/2010 | Phi et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,703,510 | B2 | 4/2010 | Xu |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,743,836 | B2 | 6/2010 | Cook et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Barnett |
| 7,775,284 | B2 | 8/2010 | Richards et al. |
| 7,775,285 | B2 | 8/2010 | Surjaatmadja et al. |
| 7,775,286 | B2 | 8/2010 | Duphorne |
| 7,784,543 | B2 | 8/2010 | Johnson |
| 7,793,714 | B2 | 9/2010 | Johnson |
| 7,793,820 | B2 | 9/2010 | Hirano et al. |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,851,016 | B2 | 12/2010 | Arbab et al. |
| 7,855,168 | B2 | 12/2010 | Fuller et al. |
| 7,861,779 | B2 | 1/2011 | Vestavik |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,879,367 | B2 | 2/2011 | Heublein et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clark et al. |
| 7,909,104 | B2 | 3/2011 | Bjorgum |
| 7,909,110 | B2 | 3/2011 | Sharma et al. |
| 7,909,115 | B2 | 3/2011 | Grove et al. |
| 7,913,765 | B2 | 3/2011 | Crow et al. |
| 7,918,275 | B2 | 4/2011 | Clem |
| 7,931,093 | B2 | 4/2011 | Foster et al. |
| 7,938,191 | B2 | 5/2011 | Vaidya |
| 7,946,335 | B2 | 5/2011 | Bewlay et al. |
| 7,946,340 | B2 | 5/2011 | Surjaatmadja et al. |
| 7,958,940 | B2 | 6/2011 | Jameson |
| 7,963,331 | B2 | 6/2011 | Surjaatmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 7,992,763 | B2 | 8/2011 | Vecchio et al. |
| 8,002,821 | B2 | 8/2011 | Stinson |
| 8,020,619 | B1 | 9/2011 | Robertson et al. |
| 8,020,620 | B2 | 9/2011 | Daniels et al. |
| 8,025,104 | B2 | 9/2011 | Cooke, Jr. |
| 8,028,767 | B2 | 10/2011 | Radford et al. |
| 8,033,331 | B2 | 10/2011 | Themig |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 8,109,340 | B2 | 2/2012 | Doane et al. |
| 8,114,148 | B2 | 2/2012 | Atanasoska et al. |
| 8,127,856 | B1 | 3/2012 | Nish et al. |
| 8,153,052 | B2 | 4/2012 | Jackson et al. |
| 8,163,060 | B2 | 4/2012 | Imanishi et al. |
| 8,211,247 | B2 | 7/2012 | Marya et al. |
| 8,211,248 | B2 | 7/2012 | Marya |
| 8,220,554 | B2 | 7/2012 | Jordan et al. |
| 8,226,740 | B2 | 7/2012 | Chaumonnot et al. |
| 8,230,731 | B2 | 7/2012 | Dyer et al. |
| 8,231,947 | B2 | 7/2012 | Vaidya et al. |
| 8,263,178 | B2 | 9/2012 | Boulos et al. |
| 8,267,177 | B1 | 9/2012 | Vogel et al. |
| 8,276,670 | B2 | 10/2012 | Patel |
| 8,277,974 | B2 | 10/2012 | Kumar et al. |
| 8,297,364 | B2 | 10/2012 | Agrawal et al. |
| 8,327,931 | B2 | 12/2012 | Agrawal et al. |
| 8,403,037 | B2 | 3/2013 | Agrawal et al. |
| 8,413,727 | B2 | 4/2013 | Holmes |
| 8,425,651 | B2 | 4/2013 | Xu et al. |
| 8,459,347 | B2 | 6/2013 | Stout |
| 8,486,329 | B2 | 7/2013 | Shikai et al. |
| 8,490,674 | B2 | 7/2013 | Stevens et al. |
| 8,490,689 | B1 | 7/2013 | McClinton et al. |
| 8,535,604 | B1 | 9/2013 | Baker et al. |
| 8,573,295 | B2 | 11/2013 | Johnson et al. |
| 8,579,023 | B1 | 11/2013 | Nish et al. |
| 8,631,876 | B2 | 1/2014 | Xu et al. |
| 8,663,401 | B2 | 3/2014 | Marya et al. |
| 8,715,339 | B2 | 5/2014 | Atanasoska et al. |
| 8,734,602 | B2 | 5/2014 | Li et al. |
| 8,770,261 | B2 | 7/2014 | Marya |
| 8,905,147 | B2 | 12/2014 | Fripp et al. |
| 8,956,660 | B2 | 2/2015 | Launag et al. |
| 8,978,734 | B2 | 3/2015 | Stevens |
| 8,998,978 | B2 | 4/2015 | Wang |
| 9,033,041 | B2 | 5/2015 | Baihly et al. |
| 9,033,060 | B2 | 5/2015 | Xu et al. |
| 9,044,397 | B2 | 6/2015 | Choi et al. |
| 9,057,117 | B2 | 6/2015 | Harrison et al. |
| 9,057,242 | B2 | 6/2015 | Mazyar et al. |
| 9,079,246 | B2 | 7/2015 | Xu et al. |
| 9,080,098 | B2 | 7/2015 | Xu et al. |
| 9,080,403 | B2 | 7/2015 | Xu et al. |
| 9,089,408 | B2 | 7/2015 | Xu |
| 9,101,978 | B2 | 8/2015 | Xu et al. |
| 9,119,906 | B2 | 9/2015 | Tomantschger et al. |
| 9,163,467 | B2 | 10/2015 | Gaudette et al. |
| 9,260,935 | B2 | 2/2016 | Murphree et al. |
| 9,309,733 | B2 | 4/2016 | Xu et al. |
| 9,366,106 | B2 | 6/2016 | Xu et al. |
| 10,016,810 | B2 | 7/2018 | Salinas et al. |
| 2001/0040180 | A1 | 11/2001 | Wittebrood et al. |
| 2001/0045285 | A1 | 11/2001 | Russell |
| 2001/0045288 | A1 | 11/2001 | Allamon et al. |
| 2002/0000319 | A1 | 1/2002 | Brunet |
| 2002/0007948 | A1 | 1/2002 | Bayne et al. |
| 2002/0014268 | A1 | 2/2002 | Vann |
| 2002/0020527 | A1 | 2/2002 | Kilaas et al. |

(56) References Cited

U.S. PATENT DOCUMENTS

| | | | |
|---|---|---|---|
| 2002/0066572 | A1 | 6/2002 | Muth |
| 2002/0092654 | A1 | 7/2002 | Coronado et al. |
| 2002/0096365 | A1 | 7/2002 | Berscheidt et al. |
| 2002/0104616 | A1 | 8/2002 | De et al. |
| 2002/0108756 | A1 | 8/2002 | Harrall et al. |
| 2002/0136904 | A1 | 9/2002 | Glass et al. |
| 2002/0139541 | A1 | 10/2002 | Sheffield et al. |
| 2002/0162661 | A1 | 11/2002 | Krauss et al. |
| 2003/0019639 | A1 | 1/2003 | Mackay |
| 2003/0037925 | A1 | 2/2003 | Walker et al. |
| 2003/0060374 | A1 | 3/2003 | Cooke, Jr. |
| 2003/0075326 | A1 | 4/2003 | Ebinger |
| 2003/0104147 | A1 | 6/2003 | Bretschneider et al. |
| 2003/0111728 | A1 | 6/2003 | Thai et al. |
| 2003/0127013 | A1 | 7/2003 | Zavitsanos et al. |
| 2003/0141060 | A1 | 7/2003 | Hailey et al. |
| 2003/0141061 | A1 | 7/2003 | Hailey et al. |
| 2003/0141079 | A1 | 7/2003 | Doane et al. |
| 2003/0150614 | A1 | 8/2003 | Brown et al. |
| 2003/0155114 | A1 | 8/2003 | Pedersen et al. |
| 2003/0155115 | A1 | 8/2003 | Pedersen et al. |
| 2003/0159828 | A1 | 8/2003 | Howard et al. |
| 2003/0164237 | A1 | 9/2003 | Butterfield |
| 2003/0183391 | A1 | 10/2003 | Hriscu et al. |
| 2003/0226668 | A1 | 12/2003 | Zimmerman et al. |
| 2004/0005483 | A1 | 1/2004 | Lin |
| 2004/0020832 | A1 | 2/2004 | Richards et al. |
| 2004/0031605 | A1 | 2/2004 | Mickey |
| 2004/0045723 | A1 | 3/2004 | Slup et al. |
| 2004/0055758 | A1 | 3/2004 | Brezinski et al. |
| 2004/0058167 | A1 | 3/2004 | Arbab et al. |
| 2004/0069502 | A1 | 4/2004 | Luke |
| 2004/0089449 | A1 | 5/2004 | Walton et al. |
| 2004/0094297 | A1 | 5/2004 | Malone et al. |
| 2004/0154806 | A1 | 8/2004 | Bode et al. |
| 2004/0159428 | A1 | 8/2004 | Hammond et al. |
| 2004/0159446 | A1 | 8/2004 | Haugen et al. |
| 2004/0182583 | A1 | 9/2004 | Doane et al. |
| 2004/0216868 | A1 | 11/2004 | Owen, Sr. |
| 2004/0231845 | A1 | 11/2004 | Cooke, Jr. |
| 2004/0244968 | A1 | 12/2004 | Cook et al. |
| 2004/0251025 | A1 | 12/2004 | Giroux et al. |
| 2004/0256109 | A1 | 12/2004 | Johnson |
| 2004/0256157 | A1 | 12/2004 | Tessari et al. |
| 2004/0261993 | A1 | 12/2004 | Nguyen |
| 2004/0261994 | A1 | 12/2004 | Nguyen et al. |
| 2005/0034876 | A1 | 2/2005 | Doane et al. |
| 2005/0051329 | A1 | 3/2005 | Blaisdell |
| 2005/0064247 | A1 | 3/2005 | Sane et al. |
| 2005/0069449 | A1 | 3/2005 | Jackson et al. |
| 2005/0074612 | A1 | 4/2005 | Eklund et al. |
| 2005/0098313 | A1 | 5/2005 | Atkins et al. |
| 2005/0102255 | A1 | 5/2005 | Bultman |
| 2005/0106316 | A1 | 5/2005 | Rigney et al. |
| 2005/0126334 | A1 | 6/2005 | Mirchandani |
| 2005/0161212 | A1 | 7/2005 | Leismer et al. |
| 2005/0161224 | A1 | 7/2005 | Starr et al. |
| 2005/0165149 | A1 | 7/2005 | Chanak et al. |
| 2005/0194143 | A1 | 9/2005 | Xu et al. |
| 2005/0199401 | A1 | 9/2005 | Patel et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2005/0235757 | A1 | 10/2005 | De Jonge et al. |
| 2005/0241824 | A1 | 11/2005 | Burris, II et al. |
| 2005/0241825 | A1 | 11/2005 | Burris, II et al. |
| 2005/0257936 | A1 | 11/2005 | Lehr |
| 2005/0268746 | A1 | 12/2005 | Abkowitz et al. |
| 2005/0275143 | A1 | 12/2005 | Toth |
| 2005/0279501 | A1 | 12/2005 | Surjaatmadja et al. |
| 2006/0012087 | A1 | 1/2006 | Matsuda et al. |
| 2006/0013350 | A1 | 1/2006 | Akers |
| 2006/0045787 | A1 | 3/2006 | Jandeska et al. |
| 2006/0057479 | A1 | 3/2006 | Niimi et al. |
| 2006/0081378 | A1 | 4/2006 | Howard et al. |
| 2006/0102871 | A1 | 5/2006 | Wang |
| 2006/0108114 | A1 | 5/2006 | Johnson et al. |
| 2006/0108126 | A1 | 5/2006 | Horn et al. |
| 2006/0110615 | A1 | 5/2006 | Karim et al. |
| 2006/0116696 | A1 | 6/2006 | Odermatt et al. |
| 2006/0124310 | A1 | 6/2006 | Lopez De Cardenas et al. |
| 2006/0131011 | A1 | 6/2006 | Lynde et al. |
| 2006/0131031 | A1 | 6/2006 | McKeachnie et al. |
| 2006/0131081 | A1 | 6/2006 | Mirchandani et al. |
| 2006/0134312 | A1 | 6/2006 | Rytlewski et al. |
| 2006/0144515 | A1 | 7/2006 | Tada et al. |
| 2006/0150770 | A1 | 7/2006 | Freim |
| 2006/0151178 | A1 | 7/2006 | Howard et al. |
| 2006/0153728 | A1 | 7/2006 | Schoenung et al. |
| 2006/0162927 | A1 | 7/2006 | Walker et al. |
| 2006/0169453 | A1 | 8/2006 | Savery et al. |
| 2006/0186602 | A1 | 8/2006 | Martin et al. |
| 2006/0207763 | A1 | 9/2006 | Hofman et al. |
| 2006/0213670 | A1 | 9/2006 | Bishop et al. |
| 2006/0231253 | A1 | 10/2006 | Vilela et al. |
| 2006/0269437 | A1 | 11/2006 | Pandey |
| 2006/0283592 | A1 | 12/2006 | Sierra et al. |
| 2007/0017674 | A1 | 1/2007 | Blaisdell |
| 2007/0017675 | A1 | 1/2007 | Hammami |
| 2007/0029082 | A1 | 2/2007 | Giroux et al. |
| 2007/0039161 | A1 | 2/2007 | Garcia |
| 2007/0039741 | A1 | 2/2007 | Hailey |
| 2007/0044958 | A1 | 3/2007 | Rytlewski et al. |
| 2007/0044966 | A1 | 3/2007 | Davies et al. |
| 2007/0051521 | A1 | 3/2007 | Fike et al. |
| 2007/0053785 | A1 | 3/2007 | Hetz et al. |
| 2007/0054101 | A1 | 3/2007 | Sigalas et al. |
| 2007/0057415 | A1 | 3/2007 | Katagiri et al. |
| 2007/0062644 | A1 | 3/2007 | Nakamura et al. |
| 2007/0074601 | A1 | 4/2007 | Hong et al. |
| 2007/0074873 | A1 | 4/2007 | McKeachnie et al. |
| 2007/0102199 | A1 | 5/2007 | Smith et al. |
| 2007/0107899 | A1 | 5/2007 | Werner et al. |
| 2007/0107908 | A1 | 5/2007 | Vaidya et al. |
| 2007/0108060 | A1 | 5/2007 | Park |
| 2007/0119600 | A1 | 5/2007 | Slup et al. |
| 2007/0131912 | A1 | 6/2007 | Simone et al. |
| 2007/0134496 | A1 | 6/2007 | Ka |
| 2007/0151009 | A1 | 7/2007 | Conrad, III et al. |
| 2007/0151769 | A1 | 7/2007 | Slutz et al. |
| 2007/0169935 | A1 | 7/2007 | Akbar et al. |
| 2007/0181224 | A1 | 8/2007 | Marya et al. |
| 2007/0185655 | A1 | 8/2007 | Le Bemadjiel |
| 2007/0187095 | A1 | 8/2007 | Walker et al. |
| 2007/0207182 | A1 | 9/2007 | Weber et al. |
| 2007/0221373 | A1 | 9/2007 | Murray |
| 2007/0221384 | A1 | 9/2007 | Murray |
| 2007/0227745 | A1 | 10/2007 | Roberts et al. |
| 2007/0259994 | A1 | 11/2007 | Tour et al. |
| 2007/0261862 | A1 | 11/2007 | Murray |
| 2007/0270942 | A1 | 11/2007 | Thomas |
| 2007/0272411 | A1 | 11/2007 | Lopez De Cardenas et al. |
| 2007/0272413 | A1 | 11/2007 | Rytlewski et al. |
| 2007/0277979 | A1 | 12/2007 | Todd et al. |
| 2007/0284109 | A1 | 12/2007 | East et al. |
| 2007/0284112 | A1 | 12/2007 | Magne et al. |
| 2007/0299510 | A1 | 12/2007 | Venkatraman et al. |
| 2008/0011473 | A1 | 1/2008 | Wood et al. |
| 2008/0020923 | A1 | 1/2008 | Debe et al. |
| 2008/0047707 | A1 | 2/2008 | Boney et al. |
| 2008/0060810 | A9 | 3/2008 | Nguyen et al. |
| 2008/0066923 | A1 | 3/2008 | Xu |
| 2008/0066924 | A1 | 3/2008 | Xu |
| 2008/0072705 | A1 | 3/2008 | Chaumonnot et al. |
| 2008/0078553 | A1 | 4/2008 | George |
| 2008/0081866 | A1 | 4/2008 | Gong et al. |
| 2008/0093073 | A1 | 4/2008 | Bustos et al. |
| 2008/0099209 | A1 | 5/2008 | Loretz et al. |
| 2008/0105438 | A1 | 5/2008 | Jordan et al. |
| 2008/0115932 | A1 | 5/2008 | Cooke |
| 2008/0121390 | A1 | 5/2008 | O'Malley et al. |
| 2008/0121436 | A1 | 5/2008 | Slay et al. |
| 2008/0127475 | A1 | 6/2008 | Griffo |
| 2008/0135249 | A1 | 6/2008 | Fripp et al. |

(56) References Cited

U.S. PATENT DOCUMENTS

2008/0149325 A1 6/2008 Crawford
2008/0149345 A1 6/2008 Bicerano
2008/0149351 A1 6/2008 Marya et al.
2008/0169105 A1 7/2008 Williamson et al.
2008/0169130 A1 7/2008 Norman et al.
2008/0179060 A1 7/2008 Surjaatmadja et al.
2008/0179104 A1 7/2008 Zhang et al.
2008/0196801 A1 8/2008 Zhao et al.
2008/0202764 A1 8/2008 Clayton et al.
2008/0202814 A1 8/2008 Lyons et al.
2008/0210473 A1 9/2008 Zhang et al.
2008/0216383 A1 9/2008 Pierick et al.
2008/0223586 A1 9/2008 Barnett
2008/0223587 A1 9/2008 Cherewyk
2008/0236829 A1 10/2008 Lynde
2008/0236842 A1 10/2008 Bhavsar et al.
2008/0248205 A1 10/2008 Blanchet et al.
2008/0248413 A1 10/2008 Ishii et al.
2008/0257549 A1 10/2008 Swor et al.
2008/0264205 A1 10/2008 Zeng et al.
2008/0264594 A1 10/2008 Lohmueller et al.
2008/0277109 A1 11/2008 Vaidya
2008/0277980 A1 11/2008 Koda et al.
2008/0282924 A1 11/2008 Saenger et al.
2008/0296024 A1 12/2008 Tianping et al.
2008/0302538 A1 12/2008 Hofman
2008/0314581 A1 12/2008 Brown
2008/0314588 A1 12/2008 Langlais et al.
2009/0038858 A1 2/2009 Griffo et al.
2009/0044946 A1 2/2009 Schasteen et al.
2009/0044949 A1 2/2009 King et al.
2009/0044955 A1 2/2009 King et al.
2009/0050334 A1 2/2009 Marya et al.
2009/0056934 A1 3/2009 Xu
2009/0065216 A1 3/2009 Frazier
2009/0068051 A1 3/2009 Gross
2009/0074603 A1 3/2009 Chan et al.
2009/0084553 A1 4/2009 Rytlewski et al.
2009/0084556 A1 4/2009 Richards et al.
2009/0084600 A1 4/2009 Severance
2009/0090440 A1 4/2009 Kellett et al.
2009/0107684 A1 4/2009 Cooke, Jr.
2009/0114381 A1 5/2009 Stroobants
2009/0114382 A1 5/2009 Grove et al.
2009/0126436 A1 5/2009 Fly et al.
2009/0139720 A1 6/2009 Frazier
2009/0145666 A1 6/2009 Radford et al.
2009/0151949 A1 6/2009 Marya et al.
2009/0152009 A1 6/2009 Slay et al.
2009/0155616 A1 6/2009 Thamida et al.
2009/0159289 A1 6/2009 Avant et al.
2009/0178808 A1 7/2009 Williamson et al.
2009/0194273 A1 8/2009 Surjaatmadja et al.
2009/0194745 A1 8/2009 Tanaka et al.
2009/0205841 A1 8/2009 Kluge et al.
2009/0211770 A1 8/2009 Nutley et al.
2009/0226340 A1 9/2009 Marya
2009/0226704 A1 9/2009 Kauppinen et al.
2009/0242202 A1 10/2009 Rispler et al.
2009/0242208 A1 10/2009 Bolding
2009/0242214 A1 10/2009 Foster et al.
2009/0255667 A1 10/2009 Clem et al.
2009/0255684 A1 10/2009 Bolding
2009/0255686 A1 10/2009 Richard
2009/0266548 A1 10/2009 Olsen et al.
2009/0260817 A1 11/2009 Gambier et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0305131 A1 12/2009 Kumar et al.
2009/0308588 A1 12/2009 Howell et al.
2009/0317556 A1 12/2009 Macary
2009/0317622 A1 12/2009 Huang et al.
2010/0003536 A1 1/2010 Smith et al.
2010/0012385 A1 1/2010 Drivdahl et al.
2010/0015002 A1 1/2010 Barrera et al.
2010/0015469 A1 1/2010 Romanowski et al.
2010/0025255 A1 2/2010 Su et al.
2010/0032151 A1 2/2010 Duphorne et al.
2010/0034857 A1 2/2010 Launag et al.
2010/0038076 A1 2/2010 Spray et al.
2010/0038595 A1 2/2010 Imholt et al.
2010/0040180 A1 2/2010 Kim et al.
2010/0044041 A1 2/2010 Smith et al.
2010/0051278 A1 3/2010 Mytopher et al.
2010/0055491 A1 3/2010 Vecchio et al.
2010/0055492 A1 3/2010 Barsoum et al.
2010/0089583 A1 4/2010 Xu et al.
2010/0089587 A1 4/2010 Stout
2010/0101803 A1 4/2010 Clayton et al.
2010/0116495 A1 5/2010 Spray
2010/0122817 A1 5/2010 Surjaatmadja et al.
2010/0139930 A1 6/2010 Patel et al.
2010/0200230 A1 8/2010 East, Jr. et al.
2010/0209288 A1 8/2010 Marya
2010/0236793 A1 9/2010 Bjorgum
2010/0236794 A1 9/2010 Duan et al.
2010/0243254 A1 9/2010 Murphy et al.
2010/0252273 A1 10/2010 Duphorne
2010/0252280 A1 10/2010 Swor et al.
2010/0270031 A1 10/2010 Patel
2010/0276136 A1 11/2010 Evans et al.
2010/0276159 A1 11/2010 Mailand et al.
2010/0282338 A1 11/2010 Gerrard et al.
2010/0282469 A1 11/2010 Richard et al.
2010/0294510 A1 11/2010 Holmes
2010/0297432 A1 11/2010 Sherman et al.
2010/0314105 A1 12/2010 Rose
2010/0314126 A1 12/2010 Kellner
2010/0319427 A1 12/2010 Lohbeck
2010/0319870 A1 12/2010 Bewlay et al.
2010/0326650 A1 12/2010 Tran et al.
2011/0005773 A1 1/2011 Dusterhoft et al.
2011/0036592 A1 2/2011 Fay
2011/0048743 A1 3/2011 Stafford et al.
2011/0052805 A1 3/2011 Bordere et al.
2011/0056692 A1 3/2011 Lopez De Cardenas et al.
2011/0056702 A1 3/2011 Sharma et al.
2011/0067872 A1 3/2011 Agrawal
2011/0067889 A1 3/2011 Marya et al.
2011/0067890 A1 3/2011 Themig
2011/0088891 A1 4/2011 Stout
2011/0094406 A1 4/2011 Marya et al.
2011/0100643 A1 5/2011 Themig et al.
2011/0127044 A1 6/2011 Radford et al.
2011/0132143 A1 6/2011 Xu et al.
2011/0132612 A1 6/2011 Agrawal et al.
2011/0132619 A1 6/2011 Agrawal et al.
2011/0132620 A1 6/2011 Agrawal et al.
2011/0132621 A1 6/2011 Agrawal et al.
2011/0135530 A1 6/2011 Xu et al.
2011/0135805 A1 6/2011 Doucet et al.
2011/0135953 A1 6/2011 Xu et al.
2011/0136707 A1 6/2011 Xu et al.
2011/0139465 A1 6/2011 Tibbles et al.
2011/0147014 A1 6/2011 Chen et al.
2011/0186306 A1 8/2011 Marya et al.
2011/0192613 A1* 8/2011 Garcia ..... E21B 23/08 166/373
2011/0214881 A1 9/2011 Newton
2011/0247833 A1 10/2011 Todd et al.
2011/0253387 A1 10/2011 Ervin
2011/0256356 A1 10/2011 Tomantschger et al.
2011/0259610 A1 10/2011 Shkurti et al.
2011/0277987 A1 11/2011 Frazier
2011/0277989 A1 11/2011 Frazier
2011/0277996 A1 11/2011 Cullick et al.
2011/0284232 A1 11/2011 Huang
2011/0284240 A1 11/2011 Chen et al.
2011/0284243 A1 11/2011 Frazier
2011/0300403 A1 12/2011 Vecchio et al.
2011/0314881 A1 12/2011 Hatcher et al.
2012/0024109 A1 2/2012 Xu et al.

(56) References Cited

U.S. PATENT DOCUMENTS

| | | | |
|---|---|---|---|
| 2012/0046732 | A1 | 2/2012 | Sillekens et al. |
| 2012/0067426 | A1 | 3/2012 | Soni et al. |
| 2012/0090839 | A1 | 4/2012 | Rudic |
| 2012/0103135 | A1 | 5/2012 | Xu et al. |
| 2012/0107590 | A1 | 5/2012 | Xu et al. |
| 2012/0118583 | A1 | 5/2012 | Johnson et al. |
| 2012/0130470 | A1 | 5/2012 | Agnew |
| 2012/0145378 | A1 | 6/2012 | Frazier et al. |
| 2012/0145389 | A1 | 6/2012 | Fitzpatrick, Jr. |
| 2012/0168152 | A1 | 7/2012 | Casciaro et al. |
| 2012/0177905 | A1 | 7/2012 | Seals et al. |
| 2012/0205120 | A1 | 8/2012 | Howell |
| 2012/0205872 | A1 | 8/2012 | Reinhardt et al. |
| 2012/0211239 | A1 | 8/2012 | Kritzler et al. |
| 2012/0234546 | A1 | 9/2012 | Xu et al. |
| 2012/0234547 | A1 | 9/2012 | O'Malley et al. |
| 2012/0267101 | A1 | 10/2012 | Cooke |
| 2012/0269673 | A1 | 10/2012 | Koo et al. |
| 2012/0292053 | A1 | 11/2012 | Xu et al. |
| 2012/0318513 | A1 | 12/2012 | Mazyar et al. |
| 2013/0004847 | A1 | 1/2013 | Kumar et al. |
| 2013/0008671 | A1 | 1/2013 | Booth et al. |
| 2013/0017610 | A1 | 1/2013 | Roberts et al. |
| 2013/0025409 | A1 | 1/2013 | Xu |
| 2013/0029886 | A1 | 1/2013 | Mazyar et al. |
| 2013/0032357 | A1 | 2/2013 | Mazyar et al. |
| 2013/0048304 | A1 | 2/2013 | Agrawal et al. |
| 2013/0048305 | A1 | 2/2013 | Xu et al. |
| 2013/0052472 | A1 | 2/2013 | Xu |
| 2013/0081814 | A1 | 4/2013 | Gaudette et al. |
| 2013/0084643 | A1 | 4/2013 | Commarieu et al. |
| 2013/0105159 | A1 | 5/2013 | Alvarez |
| 2013/0126190 | A1 | 5/2013 | Mazyar et al. |
| 2013/0133897 | A1 | 5/2013 | Baihly et al. |
| 2013/0144290 | A1 | 6/2013 | Schiffl et al. |
| 2013/0146144 | A1 | 6/2013 | Joseph et al. |
| 2013/0146302 | A1 | 6/2013 | Gaudette et al. |
| 2013/0167502 | A1 | 7/2013 | Wilson et al. |
| 2013/0168257 | A1 | 7/2013 | Mazyar et al. |
| 2013/0186626 | A1 | 7/2013 | Aitken et al. |
| 2013/0240200 | A1 | 9/2013 | Frazier |
| 2013/0240203 | A1 | 9/2013 | Frazier |
| 2013/0277044 | A1 | 10/2013 | King et al. |
| 2013/0299185 | A1 | 11/2013 | Xu et al. |
| 2013/0299192 | A1 | 11/2013 | Xu et al. |
| 2013/0300066 | A1 | 11/2013 | Xu et al. |
| 2013/0319668 | A1 | 12/2013 | Tschetter et al. |
| 2013/0327540 | A1 | 12/2013 | Hamid et al. |
| 2014/0014339 | A1 | 1/2014 | O'Malley et al. |
| 2014/0020712 | A1 | 1/2014 | Benson |
| 2014/0027128 | A1 | 1/2014 | Johnson et al. |
| 2014/0060834 | A1 | 3/2014 | Quintero et al. |
| 2014/0110112 | A1 | 4/2014 | Jordan, Jr. |
| 2014/0116711 | A1 | 5/2014 | Tang et al. |
| 2014/0124216 | A1 | 5/2014 | Fripp et al. |
| 2014/0154341 | A1 | 6/2014 | Manuel et al. |
| 2014/0186207 | A1 | 7/2014 | Bae et al. |
| 2014/0190705 | A1 | 7/2014 | Fripp et al. |
| 2014/0196899 | A1 | 7/2014 | Jordan et al. |
| 2014/0224507 | A1 | 8/2014 | Fripp et al. |
| 2014/0262327 | A1 | 9/2014 | Xu et al. |
| 2014/0284063 | A1 | 9/2014 | Fripp et al. |
| 2014/0311731 | A1 | 10/2014 | Smith |
| 2014/0311752 | A1 | 10/2014 | Streich et al. |
| 2014/0360728 | A1 | 12/2014 | Tashiro et al. |
| 2015/0060085 | A1 | 3/2015 | Xu |
| 2015/0065401 | A1 | 3/2015 | Xu et al. |
| 2015/0184485 | A1 | 7/2015 | Xu et al. |
| 2015/0240337 | A1 | 8/2015 | Sherman et al. |
| 2015/0247376 | A1 | 9/2015 | Tolman et al. |
| 2015/0299838 | A1 | 10/2015 | Doud et al. |
| 2016/0128849 | A1 | 5/2016 | Sirhan et al. |
| 2016/0209391 | A1 | 7/2016 | Zhang et al. |
| 2016/0258242 | A1 | 9/2016 | Hayter et al. |
| 2016/0272882 | A1 | 9/2016 | Stray et al. |
| 2016/0279709 | A1 | 9/2016 | Xu et al. |
| 2017/0044675 | A1 | 2/2017 | Xu et al. |
| 2017/0165745 | A1 | 6/2017 | Salinas et al. |
| 2017/0266923 | A1 | 9/2017 | Guest et al. |
| 2018/0023359 | A1 | 1/2018 | Xu |
| 2018/0178289 | A1 | 6/2018 | Xu |
| 2018/0187510 | A1 | 7/2018 | Xu et al. |

FOREIGN PATENT DOCUMENTS

| | | | |
|---|---|---|---|
| CN | 1076968 | A | 10/1993 |
| CN | 1079234 | A | 12/1993 |
| CN | 1255879 | A | 6/2000 |
| CN | 2658384 | Y | 11/2004 |
| CN | 1668545 | A | 9/2005 |
| CN | 1882759 | A1 | 12/2006 |
| CN | 10105417 | A | 10/2007 |
| CN | 11351523 | A | 1/2009 |
| CN | 101454074 | A | 6/2009 |
| CN | 101457321 | A | 6/2009 |
| CN | 101605963 | | 12/2009 |
| CN | 101720378 | A | 6/2010 |
| EP | 0033625 | A1 | 8/1981 |
| EP | 1006258 | A2 | 6/2000 |
| EP | 1174385 | A2 | 1/2002 |
| EP | 1412175 | A1 | 4/2004 |
| EP | 1493517 | A2 | 1/2005 |
| EP | 1798301 | A1 | 8/2006 |
| EP | 1857570 | A2 | 11/2007 |
| FR | 2782096 | A1 | 2/2000 |
| GB | 912956 | | 12/1962 |
| GB | 1046330 | A | 10/1966 |
| GB | 1280833 | A | 7/1972 |
| GB | 1357065 | A | 6/1974 |
| JP | 61067770 | | 4/1986 |
| JP | 754008 | A | 2/1995 |
| JP | 8232029 | A | 9/1996 |
| JP | 2000185725 | A1 | 7/2000 |
| JP | 2002053902 | A | 2/2002 |
| JP | 2004225084 | A | 8/2004 |
| JP | 2004225765 | A | 8/2004 |
| JP | 2005076052 | A | 3/2005 |
| JP | 2009144207 | A | 7/2009 |
| JP | 2010502840 | A | 1/2010 |
| KR | 950014350 | B1 | 11/1995 |
| WO | 9909227 | A1 | 2/1999 |
| WO | 9947726 | | 9/1999 |
| WO | 03008186 | A1 | 1/2003 |
| WO | 2004001087 | A1 | 12/2003 |
| WO | 2004073889 | A1 | 9/2004 |
| WO | 2005040068 | A | 5/2005 |
| WO | 2005065281 | A2 | 7/2005 |
| WO | 2007044635 | A | 4/2007 |
| WO | 2007095376 | A2 | 8/2007 |
| WO | 2008034042 | A3 | 3/2008 |
| WO | 2008057045 | A1 | 5/2008 |
| WO | 2008079485 | A2 | 7/2008 |
| WO | 2008079777 | A2 | 7/2008 |
| WO | 2008142129 | | 11/2008 |
| WO | 2009079745 | A1 | 7/2009 |
| WO | 2010012184 | A1 | 2/2010 |
| WO | 2010083826 | | 7/2010 |
| WO | 2011071902 | A2 | 6/2011 |
| WO | 2011071907 | A2 | 6/2011 |
| WO | 2011071910 | A2 | 6/2011 |
| WO | 2011130063 | A3 | 2/2012 |
| WO | 2012015567 | A2 | 2/2012 |
| WO | 2012149007 | A2 | 11/2012 |
| WO | 2012164236 | A1 | 12/2012 |
| WO | 2012174101 | A2 | 12/2012 |
| WO | 2013053057 | A1 | 4/2013 |
| WO | 2013078031 | A1 | 5/2013 |
| WO | 2014121384 | A1 | 8/2014 |
| WO | 2015142862 | A1 | 9/2015 |
| WO | 2015171585 | | 11/2015 |

(56) References Cited

FOREIGN PATENT DOCUMENTS

| | | |
|---|---|---|
| WO | 2016032493 | 3/2016 |
| WO | 2016085798 | 6/2016 |

OTHER PUBLICATIONS

"Declaration of Karl T. Hartwig in Support of Petitioner Pursuant to 37 C.F.R. § 42.120", executed on Nov. 21, 2016 in support of U.S. Pat. No. 9,101,978, 51 pages.
AP African Office Action for African Application No. AP/P/2014/007389, dated Oct. 6, 2016, 5 pages.
Australian Office Action for Patent Application No. 2012302067; dated Feb. 2, 2015, 3 pages.
Australian Patent Examination Report for Patent Application No. 2012302067 dated Sep. 22, 2015, 3 pages.
Callister, Jr., William D., Materials Science and Engineering an Introduction, Seventh Edition, 2006, pp. 111, 627, and G7.
Canadian Office Action for Application No. 2860699; dated Oct. 7, 2015, 4 pages.
Chinese Office Action for Chinese Application No. 201280041320.0; dated Jun. 6, 2016, 14 pages.
Chinese Office Action for Chinese Application No. 201380006291.9 dated Apr. 27, 2016, 25 pages.
European Search Report for European Application No. 12820355.1-1353, dated Dec. 18, 2015, 9 pages.
Extended European Search Report for EP Application No. 10836539.6-1353, dated Jul. 27, 2015, 7 pages.
German, Randall M., Powder Metallurgy Science, Second Edition, 1994, 102 pages.
International Search Report and Written Opinion, International Application No. PCT/US2016/041849, dated Oct. 26, 2016, Korean Intellectual Property Office; International Search Report 5 pages, Written Opinion 7 pages.
Klar, Erhard, ASM Handbook: International Metals Handbook—Powder Metallurgy, vol. 7, 1997, pp. 14, 276, and 798.
Petition for Inter Partes Review; Case No. IPR2017-00326; U.S. Pat. No. 9,101,978; Nov. 23, 2016; 46 pages.
Petition for Inter Partes Review; Case No. IPR2017-00327; U.S. Pat. No. 8,573,295; Nov. 23, 2016; 53 pages.
Reid, Gary Carl, "Literature evaluation of induced groundwater tracers, field tracer techniques, and hydrodynamic dispersion values in porous media", Theisis in Geosciences (Masters), Texas Tech University, Aug. 1981, 109 pages.
Schaffer, James P. et al., The Science and Design of Engineering Materials, Second Edition, 1999, pp. 122, 123, 598, and 699.
Xie, Guoqiang et al., "TEM Observation of Interfaces between Particles in Al—Mg Alloy Powder Compacts Prepared by Pulse Electric Current Sintering", Materials Transactions, 2002, pp. 2177-2180, vol. 43—No. 9.
M.S. Senthil Saravanan et al, "Mechanically Alloyed Carbon Nanotubes (CNT) Reinforced Nanocrystalline AA 4032: Synthesis and Characterization", Journal of Minerals and Materials Characterization and Engineering, vol. 9, No. 11 pp. 1027-1035 2010.
"Baker Hughes Refines Expandable Tubular Technology with Abaqus and Isight", Simulia Realistic Simulation News, Jan./Feb. 2011, pp. 12-13.
"Reactivity series", Wikipedia, http://en.wikipedia.org/w/index.php?title=Reactivity_series&printable=yes downloaded on May 18, 2014. 8 pages.
Bakshi et al., "Carbon nanotube reinforced metal matrix composites—a review," International Materials Reviews; 2010, pp. 41-64, vol. 55, No. 1.
Birbilis, et al., "Exploring Corrosion Protection of Mg Via Ionic Liquid Pretreatment", Surface & Coatings Technology; 201, pp. 4496-4504, (2007).
Canadian Office Action for Canadian Application No. 2,833,958, dated Sep. 23, 2014, pp. 1-2.
Chinese Office Action for Chinese Application No. 201080055613.5, dated Nov. 4, 2014, pp. 1-20.
Chinese Office Action for Chinese Application No. 201180012447.5, dated Jul. 3, 2014, 7 pages.
Chinese Office Action for Chinese Application No. 201180052095.6, dated Jul. 21, 2014, pp. 1-32.
Feng, et al., "Electroless Plating of Carbon Nanotubes with Silver" Journal of Materials Science, 39, (2004) pp. 3241-3243.
International Search Report and Written Opinion; International Application No. PCT/US2012/038622; International Filing Date: May 18, 2012; dated Dec. 6, 2012; 12 pages.
International Search Report and Written Opinion; International Application No. PCT/US2013/020046; International Filing Date: Jan. 3, 2013; dated Apr. 10, 2013; 7 pages.
International Search Report and Written Opinion; International Application No. PCT/US2014/054720; International Filing Date: Sep. 9, 2014; dated Dec. 17, 2014; 10 pages.
International Search Report for related PCT Application No. PCT/US2013/035258, dated Jul. 4, 2013, pp. 1-4.
International Search Report for related PCT Application No. PCT/US2013/035261, dated Jul. 10, 2013, pp. 1-4.
International Search Report for related PCT Application No. PCT/US2013/035262, dated Jul. 1, 2013, pp. 1-4.
International Search Report for related PCT Application No. PCT/US2013/068062, dated Feb. 12, 2014, pp. 1-3.
Lee, et al., "Effects of Ni addition on hydrogen storage properties of Mg17AL12 alloy", Materials Chemistry and Physics, 2011, 126, pp. 319-324.
Li, et al., "Investigation of aluminium-based nancompsoites with ultra-high strength", Materials Science and Engineering A, 527, pp. 305-316, (2009).
Liu, et al.; "Electroless Nickel Plating on AZ91 Mg Alloy Substrate"; Surface & Coatings Technology; 200; pp. 5087-5093; (2006).
Mathis, "Sand Management: A Review of Approaches and Concerns", Society of Petroleum Engineers, SPE Paper No. 82240, SPE European Formation Damage Conference, The Hague, The Netherlands, May 13-14, 2003.
Pardo, et al.; "Corrosion Behaviour of Magnesium/Aluminium Alloys in 3.5 wt% NaC1"; Corrosion Science; 50; pp. 823-834; (2008).
Quik Drill Composite Frac Plug; Baker Hughes, Baker Oil Tools; Copyright 2002; 3 pages.
Shi, et al.; "Influence of the Beta Phase on the Corrosion Performance of Anodised Coatings on Magnesium-Aluminium Alloys"; Corrosion Science; 47; pp. 2760-2777; (2005).
Shimizu, et al., "Multi-walled carbon nanotube-reinforced magnesium alloy composites", Scripta Materialia, vol. 58, Issue 4, Feb. 2008, pp. 267-270.
Shumbera, et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003.
Song, et al.; "Corrosion Mechanisms of Magnesium Alloys"; Advanced Engineering Materials; 1(1); pp. 11-33; (1999).
Song, et al.; "Influence of Microstructure on the Corrosion of Diecast AZ91D"; Corrosion Science; 41; pp. 249-273; (1999).
Song, et al.; "Understanding Magnesium Corrosion"; Advanced Engineering Materials; 5; No. 12; pp. 837-858; (2003).
Sun, et al.; "Colloidal Processing of Carbon Nanotube/Alumina Composites" Chem. Mater. 2002, 14, pp. 5169-5172.
Vickery, et al.; "New One-Trip Multi-Zone Frac Pack System with Positive Positioning." European Petroleum Conference, Oct. 29-31, 2002, Aberdeen, UK. [Abstract Only].
Zeng, et al. "Progress and Challenge for Magnesium Alloys as Biomaterials," Advanced Engineering Materials, vol. 10, Issue 8, Aug. 2008, pp. B3-B14.
Zhang, et al.; "High Strength Nanostructured Materials and Their Oil Field Applications"; Society of Petroleum Engineers; Conference Paper SPE 157092; SPE International Oilfield Nanotechnology Conference, 2012; 6 pages.
Zhang, et al.; "Metal Coating on Suspended Carbon Nanotubes and its Implication to Metal—Tube Interaction", Chemical Physics Letters 331 (2000) 35-41.
"Optisleeve Sliding Sleeve", [online]; [retrieved on Jun. 25, 2010]; retrieved from the Internet weatherford.com/weatherford/groups/.../weatherfordcorp/WFT033159.pdf.

(56) References Cited

OTHER PUBLICATIONS

Baker Hughes, "Flow Control Systems," [online]; [retrieved on May 20, 2010]; retrieved from the Internet http://www.bakerhughes.com/products-and-services/completions-and-productions/well-completions/packers-and-flow-control/flow-control-systems.
Bououdina, et al., "Comparative Study of Mechanical Alloying of (Mg+Al) and (Mg+Al+Ni) Mixtures for Hydrogen Storage", J. Alloys, Compds, 2002, 336, 222-231.
Canadian Office Action for Canadian Application No. 2,783,241, dated Feb. 25, 2013, pp. 1-3.
Canadian Office Action for Canadian Application No. 2,783,346, dated Feb. 21, 2013, pp. 1-4.
Carrejo, et al., "Improving Flow Assurance in Multi-Zone Fracturing Treatments in Hydrocarbon Resevoirs with High Strength Corrodible Tripping Balls"; Society of Petroleum Engineers; SPE Paper No. 151613; Apr. 16, 2012; 6 pages.
Coronado, "Development of an Internal Coiled Tubing Connector Utilizing Permanent Packer Technology"; Society of Petroleum Engineers, SPE Paper No. 46036; Apr. 15, 1998; 10 pages.
Garfield, New One-Trip Sand-Control Completion System that Eliminates Formation Damage Resulting From conventional Perforating and Gravel-Packing Operations:, SPE Annual Technical Conference and Exhibition, Oct. 9-12, 2005.
Gray, et al., "Protective Coatings on Magnesium and Its Alloys—a Critical Review", Journal of Alloys and Compounds 336 (2002), pp. 88-113.
Hsiao, et al., "Anodization of AZ91D Magnesium Alloy in Silicate-Containing Electrolytes"; Surface & Coatings Technology; 199; pp. 127-134; (2005).
Hsiao, et al., "Characterization of Anodic Films Formed on AZ91D Magnesium Alloy"; Surface & Coatings Technology; 190; pp. 299-308; (2005).
Huo et al.; "Corrosion of AZ91D Magnesium Alloy with a Chemical Conversion Coating and Electroless Nickel Layer"; Corrosion Science: 46; pp. 1467-1477; (2004).
International Search Report and Written Opinion; International Application No. PCT/US2011/058105; International Filing Date: Oct. 27, 2011; dated May 1, 2012; 8 pages.
International Search Report and Written Opinion; International Application No. PCT/US2012/034973; International Filing Date: Apr. 25, 2012; dated Nov. 29, 2012; 8 pages.
International Search Report and Written Opinion; International Application No. PCT/US2012/034978; International Filing Date: Apr. 25, 2012; dated Nov. 12, 2012; 9 pages.
International Search Report and Written Opinion; International Application No. PCT/US2012/044866; International Filing Date: Jun. 29, 2012; dated Jan. 2, 2013; 9 pages.
International Search Report and Written Opinion; International Application No. PCT/US2014/010862; International Filing Date: Jan. 9, 2014; dated Apr. 21, 2014; 9 pages.
International Search Report; International Application No. PCT/US2012/044229, International Filing Date: Jun. 26, 2012; dated Jan. 30, 2013; 3 pages.
Kuzumaki, et al.; "Mechanical Characteristics and Preparation of Carbon Nanotube Fiber-Reinforced Ti Composite", Advanced Engineering Materials, 2000, 2, No. 7.
Liu, et al., "Calculated Phase Diagrams and the Corrosion of Die-Cast Mg—Al Alloys", Corrosion Science, 2009, 51, 606-619.
Lunder et al.; "The Role of Mg17Al12 Phase in the Corrosion of Mg Alloy AZ91"; Corrosion; 45(9); pp. 741-748; (1989).
Majumdar, et al., "Laser Surface Engineering of a Magnesium Alloy with Al + Al2O3", Surface and Coatings Technology 179 (2004) pp. 297-305.
Murray, "Binary Alloy Phase Diagrams" Int. Met. Rev., 30(5) 1985 Vol. 1, pp. 103-187.
Nie, "Patents of Methods to Prepare Intermetallic Matrix Composites: A Review", Recent Patents on Materials Science 2008, vol. 1, pp. 232-240.
Saravanan et al., "Mechanically Alloyed Carbon Nanotubes (CNT) Reinforced Nanocrystalline AA 4032: Synthesis and Characterization," Journal of Minerals & Materials Characterization & Engineering, vol. 9, No. 11, pp. 1027-1035, 2010.
Shaw, "Benefits and Application of a Surface-Controlled Sliding Sleeve for Fracturing Operations"; Society of Petroleum Engineers, SPE Paper No. 147546; Oct. 30, 2011; 8 pages.
Song, "Recent Progress in Corrosion and Protection of Magnesium Alloys"; Advanced Engineering Materials; 7(7); pp. 563-586; (2005).
Song, et al.; "A Possible Biodegradable Magnesium Implant Material," Advanced Engineering Materials, vol. 9, Issue 4, Apr. 2007, pp. 298-302.
Song, et al.; "Corrosion Behaviour of AZ21, AZ501 and AZ91 in Sodium Chloride"; Corrosion Science; 40(10); pp. 1769-1791; (1998).
Triolo et al., "Resolving the Completion Engineer's Dilemma: Permanent or Retrievable Packer?"; Society of Petroleum Engineers, SPE Paper No. 76711; May 20, 2002; 16 pages.
Vernon Constien et al., "Development of Reactive Coatings to Protect Sand-Control Screens", SPE 112494, Copyright 2008, Society of Petroleum Engineers, Presented at the 2008 SPE International Symposium and Exhibition on Formation Damage Control.
Walters, et al.; "A Study of Jets from Unsintered-Powder Metal Lined Nonprecision Small-Caliber Shaped Charges", Army Research Laboratory, Aberdeen Proving Ground, MD 21005-5066; Feb. 2001.
Wang, et al., "Contact-Damage-Resistant Ceramic/Single-Wall Carbon Nanotubes and Ceramic/Graphite Composites" Nature Materials, vol. 3, Aug. 2004, pp. 539-544.
Watanabe, et al., "Superplastic Deformation Mechanism in Powder Metallurgy Magnesium Alloys and Composites", Acta mater. 49 (2001) pp. 2027-2037.
Watarai, Trend of research and development for magnesium alloys-reducing the weight of structural materials in motor vehicles, (2006) Science and technology trends, Quaterly review No. 18, 84-97.
Welch et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zhan, et al. "Single-wall carbon nanotubes as attractive toughening agents in alumina-based nanocomposites" Nature Materials, vol. 2, Jan. 2003, pp. 38-42.
Zhang, et al.; "Formation of metal nanowires on suspended single-walled carbon nanotubes" Applied Physics Letter, vol. 77, No. 19 (2000), pp. 3015-3017.
Zhang, et al.; "Study on the Environmentally Friendly Anodizing of AZ91D Magnesium Alloy"; Surface and Coatings Technology: 161; pp. 36-43; (2002).
Zhu, et al., "The process of coating on ultrafine particles by surface hydrolysis reaction in a fluidized bed reactor", Surface and Coatings Technology 135 (2000) 14-17.
European Search Report for EP Application No. 12827733.2 dated Jan. 21, 2015; 6 pages.
European Search Report for EP Application No. 12827915.5 dated Dec. 23, 2015; 8 pages.
European Search Report for EP Application No. 12828903.0 dated Jan. 11, 2016; 1 page.
Extended European Search Report for EP Application No. 12828379.3-1373, dated May 20, 2016, 8 pages.
International Search Report and Written Opinion; International Application No. PCT/US2015/066353; International Filing Date: Dec. 17, 2015; dated Apr. 1, 2016; 14 pages.
EP Search Report, PCT/US2012049434; Application No. EP 12823958; dated Jun. 15, 2016; 9 pages.
Adams, et al.; "Thermal stabilities of aromatic acids as geothermal tracers", Geothermics, vol. 21, No. 3, 1992, pp. 323-339.
Aviles et al, "Degradable Alternative to Risky Mill-Out Operations in Plug and Perf"; SPE-173695-MS; Society of Petroleum Engineers; SPE/ICOTA Coiled Tubing & Well Intervention Conference & Exhibition; Mar. 24-25, 2015; 10 Pages.
Ayman, et al.; "Effect of Consolidation and Extrusion Temperatures on Tensile Properties of Hot Extruded ZK61 Magnesium Alloy Gas

(56) References Cited

OTHER PUBLICATIONS

Atomized Powders via Spark Plasma Sintering", Transactions of JWRI, vol. 38 (2009), No. 2, pp. 1-5.
Baker Hughes Incorporated. IN-Tallic Disintegrating Frac Balls. Houston: Baker Hughes Incorporated, 2011. Accessed Mar. 6, 2015.
Baker Hughes, "Multistage", Oct. 31, 2011, BakerHughes.com; accessed Mar. 6, 2015.
Bin et al., "Advances in Fluidization CVD Technology", East China University of Chemical Technology, China Academic Journal Electronic Publishing House, vol. 13, No. 4, Nov. 1992, pp. 360-365, English Abstract on p. 366.
Canadian Office Action for Canadian Application No. 2,833,981, dated Sep. 23, 2014, pp. 1-2.
Canadian Office Action for Canadian Application No. 2,834,794, dated Dec. 15, 2014, pp. 1-3.
Office Action for Canadian Application No. 2,841,068, dated Jan. 23, 2015, pp. 1-3.
Canadian Office Action for Canadian Application No. 2,841,078, dated Oct. 7, 2014, pp. 1-2.
Canadian Office Action for Canadian Application No. 2,841,132, dated Mar. 11, 2015, pp. 1-4.
Canadian Office Action for Canadian Application No. 2,841,184, dated Apr. 16, 2015, pp. 1-5.
Canadian Office Action for Canadian Application No. 2,842,962, dated Mar. 19, 2015, pp. 1-6.
Canadian Office Action for Canadian Application No. 2,843,011, dated Mar. 31, 2015, pp. 1-4.
Canadian Office Action for Canadian Application No. 2,844,517, dated May 26, 2015, pp. 1-4.
Canadian Office Action for Canadian Application No. 2,845,339, dated May 1, 2015, pp. 1-3.
Canadian Office Action for Canadian Application No. 2,860,699, dated Jul. 16, 2015, pp. 1-4.
Chinese Office Action; Chinese Application No. 201180052095.6; dated Mar. 18, 2015; pp. 1-19.
Chinese Office Action; Chinese Application No. 201280036253.3; dated Apr. 22, 2015; 21 pages.
Chinese Office Action; Chinese Application No. 201280036260.3; dated May 27, 2015; pp. 1-18.
Danish Search Report and Opinion for Danish Application No. PA 2013 00060, dated Dec. 12, 2014, pp. 1-6.
International Search Report and Written Opinion; International Application No. PCT/US2012/047163; International Filing Date: Jul. 18, 2012; dated Feb. 26, 2013; 12 pages.
International Search Report and Written Opinion; International Application No. PCT/US2012/052836; International Filing Date: Aug. 29, 2012; dated Feb. 1, 2013; 9 pages.
International Search Report and Written Opinion; International Application No. PCT/US2013/050475; International Filing Date: Jul. 15, 2013; dated Oct. 10, 2013; 12 pages.
International Search Report and Written Opinion; International Application No. PCT/US2014/058997, International Filing Date: Oct. 3, 2014; dated Jan. 12, 2015; 12 pages.
Lin et al., "Processing and Microstructure of Nano-Mo/Al203 Composites from MOCVD and Fluidized Bed", Nanostructured Materials, Nov. 1999, vol. 11, No. 8, pp. 1361-1377.
Rose, et al.; "The application of the polyaromatic sulfonates as tracers in geothermal reservoirs", Geothermics 30 (2001) pp. 617-640.
Shigematsu, et al., "Surface Treatment of AZ91D Magnesium Alloy by Aluminum diffusion Coating", Journal of Materials Science Letters 19, 2000, pp. 473-475.
Singh, et al., "Extended Homogeneity Range of Intermetallic Phases in Mechanically Alloyed Mg—Al Alloys", Elsevier Sciences Ltd., Intemetallics 11, 2003, pp. 373-376.
Spencer et al., "Fluidized Bed Polymer Particle ALD Process for Producing HDPE/Alumina Nanocomposites", The 12th International Conference on Fluidization—New Horizons in Fluidization Engineering, vol. RP4 (2007).
Stanley, et al.; "An Introduction to Ground-Water Tracers", Department of Hydrology and Water Resources, University of Arizona, Mar. 1985, pp. 1-219.
Zemel, "Tracers in the Oil Field", University of Texas at Austin, Center for Petroleum and Geosystems, Jan. 1995, Chapters 1, 2, 3, 7.
Australian Examination Report for Australian patent application No. 2012302067 dated Sep. 22, 2015.
Australian Examination Report; Australian Application No. 2012287461; dated Jul. 13, 2015; 6 pages.
Chinese Office Action for Chinese Application No. 201280036477.4, dated Nov. 4, 2015, pp. 1-15.
Chinese Office Action; Chinese Application No. 201280020572.5; dated Oct. 10, 2015; 13 pages.
Chuan-Jun et al., "Study on Corrosion Kinetics of Mg—Ni alloys", Journal of Kunming University of Science and Technology, vol. 34, No. 5, pp. 10-13, Oct. 2009.
European Search Report for EP Application No. 10836538.8 dated Jul. 27, 2015.
European Search Report for EP Application No. 10836540.4 dated Aug. 20, 2015.
Tsipas et al. "Effect of High Energy Ball Milling on Titanium-Hydroxyapatite Powders" Powder Metallurgy, Maney Publishing, London, GB, vol. 46, No. 1, Mar. 2003 (Mar. 2003), pp. 73-77.
"Sliding Sleeve", Omega Completion Technology Ltd, Sep. 29, 2009, retrieved on: www.omega-completion.com.
Ambat, et al., "Electroless Nickel-Plating on AZ91D Magnesium Alloy: Effect of Substrate Microstructure and Plating Parameters"; Surface and Coatings Technology; 179; pp. 124-134; (2004).
Baker Oil Tools, "Baker Oil Tools Introduces Revolutionary Sand Control Completion Technology," May 2, 2005.
Baker Oil Tools, "Z-Seal Metal-to-Metal Expandable Sealing Device Uses Expanding Metal in Place of Elastomers," Nov. 6, 2006.
Bastow, et al., "Clustering and formation of nano-precipitates in dilute aluminum and magnesium alloys", Materials Science and Engineering, 2003, C23, 757-762.
Bercegeay, et al., "A One-Trip Gravel Packing System"; Society of Petroleum Engineers, Offshort Technology Conference, SPE Paper No. 4771; Feb. 7-8, 1974.
Bybee, "One-Trip Completion System Eliminates Perforations," Completions Today, Sep. 2007, pp. 52-53.
Canadian Office Action for Canadian Application No. 2,783,547, dated Feb. 15, 2013, pp. 1-3.
Chang, et al., "Electrodeposition of Aluminum on Magnesium Alloy in Aluminum Chloride (A1C13)-1-ethyl-3-methylimidazolium chloride (EMIC) Ionic Liquid and Its Corrosion Behavior"; Electrochemistry Communications; 9; pp. 1602-1606; (2007).
Christoglou, et al., "Deposition of Aluminum on Magnesium by a CVD Process", Surface and Coatings Technology 184 (2004) 149-155.
Constantine, "Selective Production of Horizontal Openhole Completions Using ECP and Sliding Sleeve Technology." SPE Rocky Mountain Regional Meeting, May 15-18, 1999, Gillette, Wyoming. [Abstract Only].
Curtin, et al., "CNT-reinforced ceramics and metals," Materials Today, 2004, vol. 7, pp. 44-49.
Flahaut, et al., "Carbon Nanotube-Metal-Oxide Nanocomposites: Microstructure, Electrical Conductivity and Mechanical Properties" Acta amter. 48 (2000), pp. 3803-3812.
Forsyth, et al.; "An Ionic Liquid Surface Treatment for Corrosion Protection of Magnesium Alloy AZ31"; Electrochem. Solid-State Lett. 2006 vol. 9, Issue 11, B52-B55/ 9(11); Abstract only; 1 page.
Galanty, et al. "Consolidation of metal powders during the extrusion process," Journal of Materials Processing Technology (2002), pp. 491-496.
Garfield, "Formation Damage Control Utilizing Composite-Bridge-Plug Technology for Monobore, Multizone Stimulation Operations," SPE 70004, 2001, Society of Petroleum Engineers Inc., This paper was prepared for presentation at the SPE Per.
Garfield, et al., "Maximizing Inflow Performance in Soft Sand Completions Using New One-trip Sand Control Liner Completion Technology", SPE European Formation Damage Conference, May 25-27, 2005.

(56) References Cited

OTHER PUBLICATIONS

Goh, et al., "Development of novel carbon nanotube reinforced magnesium nanocomposites using the powder metallurgy technique", Nanottechnology 17 (2006) 7-12.
Han, et al., "Mechanical Properties of Nanostructured Materials", Rev. Adv. Mater. Sci. 9(2005) 1-16.
Hermawan, et al., "Iron-manganese: new class of metallic degradable biomaterials prepared by powder metallurgy", Powder Metallurgy, vol. 51, No. 1, (2008), pp. 38-45.
Hjortstam, et al. "Can we achieve ultra-low resistivity in carbon nanotube-based metal composites," Applied Physics A (2004), vol. 78, Issue 8, pp. 1175-1179.
Hsiao, et al., "Baking Treatment Effect on Materials Characteristics and Electrochemical Behavior of anodic Film Formed on AZ91D Magnesium Alloy"; Corrosion Science; pp. 781-793; (2007)
Hsiao, et al., "Effect of Heat Treatment on Anodization and Electrochemical Behavior of AZ91D Magnesium Alloy"; J. Mater. Res.; 20(10); pp. 2763-2771;(2005).
International Search Report and Written Opinion; International Application No. PCT/US2010/057763; International Filing Date: Nov. 23, 2010; dated Jul. 28, 2011; 10 pages.
International Search Report and Written Opinion; International Application No. PCT/US2010/059257; International Filing Date: Dec. 7, 2010; dated Jul. 27, 2011; 8 pages.
International Search Report and Written Opinion; International Application No. PCT/US2010/059259; International Filing Date: Dec. 7, 2010; dated Jun. 13, 2011; 8 pages.
International Search Report and Written Opinion; International Application No. PCT/US2010/059263; International Filing Date: Dec. 7, 2010; dated Jul. 8, 2011; 9 pages.
International Search Report and Written Opinion; International Application No. PCT/US2010/059265; International Filing Date: Dec. 7, 2010; dated Jun. 16, 2011; 8 pages.
International Search Report and Written Opinion; International Application No. PCT/US2010/059268; International Filing Date: Dec. 7, 2010; dated Jun. 17, 2011; 8 pages.
International Search Report and Written Opinion; International Application No. PCT/US2011/043036; International Filing Date: Jul. 6, 2011; dated Feb. 23, 2012; 9 pages.
International Search Report and Written Opinion; International Application No. PCT/US2011/047000; International Filing Date: Aug. 9, 2011; dated Dec. 26, 2011; 8 pages.
International Search Report and Written Opinion; International Application No. PCT/US2011/058099; International Filing Date: Oct. 27, 2011; dated May 11, 2012; 12 pages.
International Search Report and Written Opinion; International Application No. PCT/US2012/046231; International Filing Date: Jul. 11, 2012; dated Jan. 29, 2013; 9 pages.
International Search Report and Written Opinion; International Application No. PCT/US2012/049434; International Filing Date: Aug. 3, 2012; dated Feb. 1, 2013; 7 pages.
International Search Report and Written Opinion; International Application No. PCT/US2012/053339; International Filing Date: Aug. 31, 2012; dated Feb. 15, 2013; 11 pages.
International Search Report and Written Opinion; International Application No. PCT/US2012/053342; International Filing Date: Aug. 31, 2012; dated Feb. 19, 2013; 9 pages.
International Search Report and Written Opinion; International Application No. PCT/US2012/053350; International Filing Date: Aug. 31, 2012; dated Feb. 25, 2013; 10 pages.
International Search Report and Written Opinion; International Application No. PCT/US2012/071742; International Filing Date: Dec. 27, 2012; dated Apr. 22, 2013; 12 pages.
Lavernia, et al.,"Cryomilled Nanostructured Materials: Processing and Properties", Materials Science and Engineering A, 493, (2008) pp. 207-214.
Li, "Design of Abrasive Water Jet Perforation and Hydraulic Fracturing Tool," Oil Field Equipment, Mar. 2011.
Maisano, "Cryomilling of Aluminum-Based and Magnesium Metal Powders", Thesis, Virginia Tech, Jan. 13, 2006.
Seyni, et al., "On the interest of using degradable fillers in co-ground composite materials", Powder Technology 190, (2009) pp. 176-184.
Vahlas, et al., "Principles and Applications of CVD Powder Technology", Materials Science and Engineering R 53 (2006) pp. 1-72.
Al-Aqeeli, et al. "Development of new Al-based nanocomposites by mechanical alloying", Materials Science and Engineering A 480 (2008) 392-396.
European Office Action, European Application No. 10836533.9-1103, dated Jul. 11, 2018, EP Patent Office; EP Office Action 6 pages.
European Office Action, European Application No. 10836539.6-1103, dated Jul. 13, 2018, EP Patent Office; EP Office Action 7 pages.
European Office Action, European Application No. 10836540.4-1103, dated Jul. 6, 2018; European Patent Office, EP Office Action 8 pages.
Xu et al. "Comparison of sizing small particles using different technologies", Powder Technology 132 (2003) 145-153.

* cited by examiner

SELECTIVELY DEGRADABLE PASSAGE RESTRICTION

CROSS REFERENCE TO RELATED APPLICATIONS

This application is a divisional of U.S. application Ser. No. 13/211,817 filed Aug. 17, 2011, the disclosure of which is incorporated by reference herein in its entirety.

BACKGROUND

Plugs, balls, darts, etc. are used in the downhole drilling and completions industry for actuating of a variety of tools and assemblies. Typically, the plugs land in a seat, blocking fluid flow through a passage and enabling a differential pressure to be created thereacross for actuating a tool or assembly. After actuation of the tool or assembly, it is often desirable to remove the resulting obstruction. Advances in selectively removable plugs and plug seats are accordingly well received by the industry.

BRIEF DESCRIPTION

An actuation system includes a tubular having a passage, and an assembly disposed with the tubular. The assembly includes a degradable restriction, the restriction only partially blocking the passage prior to being degraded. The assembly is configured to receive and prevent further movement of a restrictor through the tubular prior to the restriction being degraded. The assembly is further configured to release the restrictor when the restriction is degraded.

An actuation system includes a tubular defining a passage, and an assembly disposed within the tubular. The assembly includes a restriction operatively arranged for receiving a restrictor, the restrictor enabling actuation of the assembly. The restriction is at least partially formed from a degradable material responsive to a fluid in the passage, and the degradable material is at least partially encapsulated by a protective layer. Actuating the assembly performs a primary function and also causes at least one penetrating element to penetrate the protective layer for exposing the degradable material to the fluid.

An actuation system includes a tubular defining a passage, and an assembly disposed within the tubular, the assembly having a restriction operatively arranged for receiving a restrictor, the restrictor enabling actuation of the assembly, the restriction at least partially formed from a degradable material responsive to a fluid in the passage, a protective layer disposed on the degradable material, the degradable material including an uncovered area with respect to the protective layer, the uncovered area located on an extension from the restriction, wherein actuating the assembly performs a primary function and also exposes the degradable material to the fluid, the extension operatively arranged to delay degradation of the restriction until the extension is first degraded.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
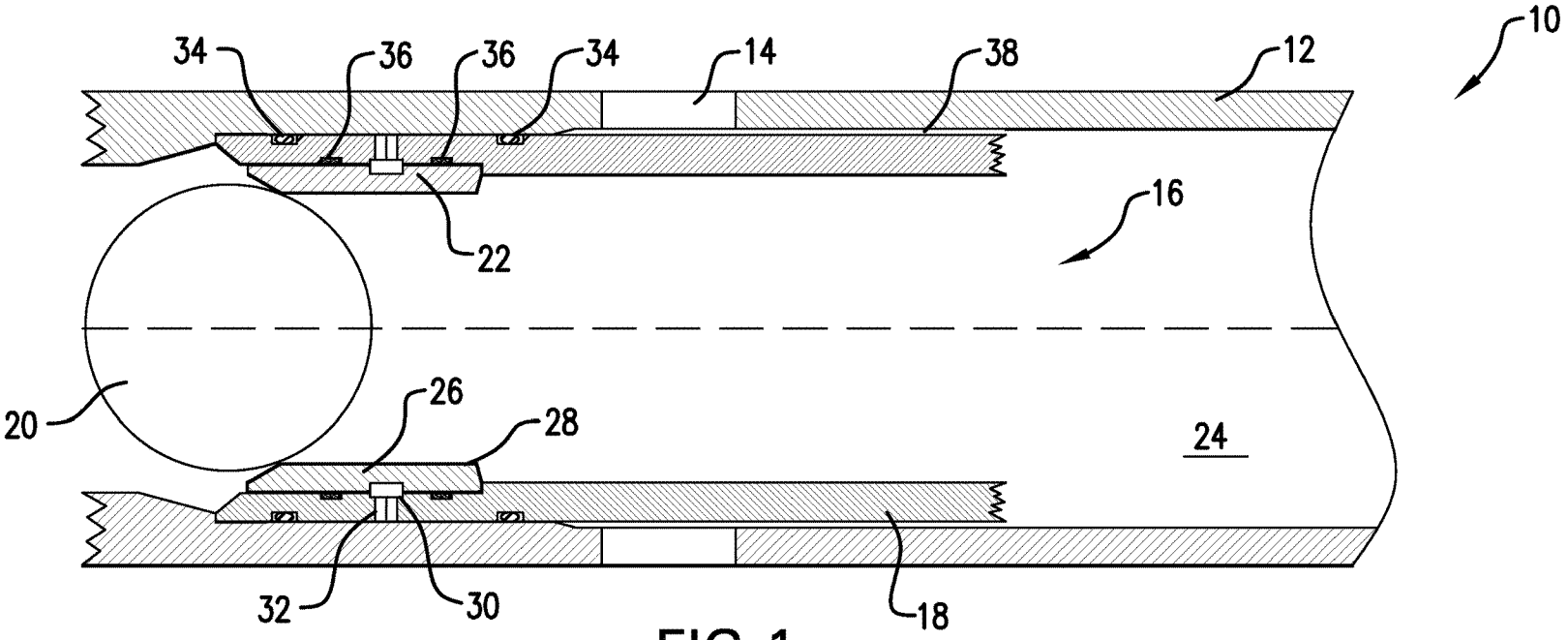
FIG. 1 is a cross-sectional view of a downhole system having an actuatable plug assembly with a degradable seat in an initial position.
Figure 2:
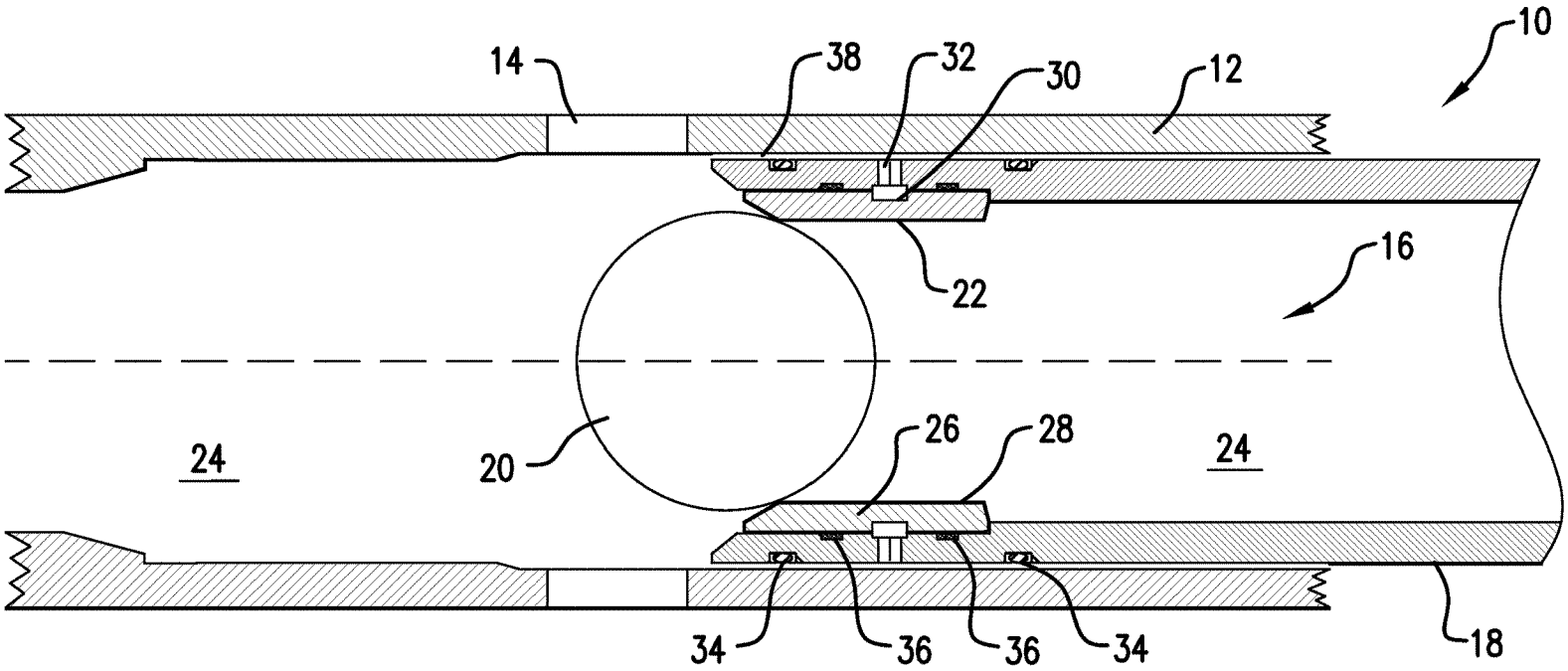
FIG. 2 is a cross-sectional view of the system of FIG. 1 with the plug assembly in an actuated position for exposing a degradable core of the seat to a downhole fluid.

Referring now to FIG. 1, a system 10 is shown including a tubular 12 having a plurality of ports 14. The ports 14 are selectively openable by use of an assembly 16, which includes a sleeve 18 actuatable by a restrictor 20. That is, by landing the restrictor 20 at a restriction 22 disposed with the sleeve 18, the restrictor 20 blocks fluid flow through a passage 24. In the illustrated embodiments, the restrictor 20 takes the form of a ball and the restriction 22 takes the form of a seat, although these are not to be considered limiting as discussed below. Blockage of the passage 24 enables a pressure differential to be formed across the restrictor 20 for urging the sleeve 18 from an initial or run-in position in which the ports 14 are closed, as shown in FIG. 1, to an actuated position in which the ports 14 are open, as shown in FIG. 2.

The assembly 16 could be used in fracturing operations or the like. The restrictor 20 could be any type of ball, dart, plug, etc. that lands at the restriction 22 for blocking fluid flow and enabling creation of a differential pressure. The restrictor 20 could alternatively be some other element that at least partially blocks fluid flow through the passage 24 and is received at least temporarily fleetingly by the restriction 22 for applying a force on the restriction 22 as it passes through or by the restriction 22, such as a collet, dart, etc. Similarly, the restriction 22 or any other restriction discussed herein could be a full or partial ring, sleeve, cup, etc., or any other member capable of at least partially restricting its corresponding passage, e.g., the passage 24. Likewise, the assembly 16 could be substituted with any other tool or assembly that is triggered, actuated, shifted, moved, opened, closed, etc. (generally, "actuated") by use of a restrictor. It is thus to be appreciated that the current invention is not limited to merely port control assemblies or fracturing operations. A release member such as a collet, shear screw, etc., could be used to hold the sleeve 18 in the initial position until a differential pressure is created across the restrictor 20 to overcome the release member.

After actuation of the sleeve 18, the restriction 22 is intended to be removed. That is, the restriction 22 includes a core 26 that is degradable upon exposure to a downhole fluid. "Degradable" is intended to mean that the core 26 is disintegratable, dissolvable, weakenable, corrodible, consumable, or otherwise removable. It is to be understood that use herein of the term "degrade", or any of its forms, incorporates the stated meaning. For example, the core 26 could be made from magnesium, aluminum, controlled electrolytic metallic materials, described in more detail below, etc. and degradable upon exposure to one or more fluids available or deliverable downhole, such as water, brine, acid, oil, etc. By exposing the core 26 to a specified downhole fluid, the restriction 22 can be removed without an intrusive, costly, or time-consuming operation such as milling. Furthermore, by degrading the core 26, the restrictor 20 will be released from the restriction 22 and pass further down the passage 24. For example, a single restrictor is thus usable to successively actuate a plurality of seats, sleeves, assemblies, tools etc. (generally, "assemblies") down the length of the tubular 12 or a string in which the tubular 12 is installed. For example, a single restrictor could be used to actuate multiple port assemblies in a fracturing operation.

It is expected that the restriction 22 will be subjected to various downhole fluids well before the restrictor 20 has encountered the restriction 22 for actuating the assembly 16. Exposure to the downhole fluids prior to actuation of the assembly 16 would disable actuation of the assembly 16. That is, without the restriction 22, the restrictor 20 would not land or otherwise be interfered with, and a pressure would not be able to be applied across or to the restrictor 20 for actuating the assembly 16. Accordingly, the degradable core 26 includes a protective layer 28. For example, by manufacturing the protective layer 28 from a material that is resistant, inert, passive, inactive, etc. with respect to the downhole fluids, the protective layer 28 will temporarily protect the degradable core 26. The protective layer 28 could be made from, for example, cladding, polymers, thermosets, thermoplastics, elastomers, resins, epoxies, etc. In addition to chemical protection, the layer 28 could also lend additional mechanical strength or durability to the core 26 to protect the core 26 from impact or erosion. The layer 28 could be any thickness, e.g., based on the material used, properties desired to be imparted to the core 26, etc.

In the embodiment of FIGS. 1 and 2, the protective layer 28 does not fully enclose or encapsulate the core 26. That is, the core 26 includes an unprotected area 30 that is not coated by the protective layer 28. A channel 32 extends from the unprotected area 30 through the sleeve 18. When the sleeve 18 is in the initial position of FIG. 1, the channel 32 and the unprotected area 30 of the core 26 are isolated from the downhole fluids via a first pair of seals 34 located between the sleeve 18 and the tubular 12 and a second pair of seals 36 located between the sleeve 18 and the restriction 22. The seals 34 and 36 are, for example, o-rings, bonded seals, or any other suitable sealing element and can be manufactured from any suitable material known in the art. The seals 34 and 36 also isolate the sides of the passage 24 on opposite sides of the restrictor 20 from each other such that a differential pressure can be formed thereacross.

After actuation of the assembly 16, the differential pressure across the restrictor 20 is no longer needed and the restriction 22 and/or the restrictor 20 can be removed. In order to expose the core 26 to the downhole fluid, the protective layer 28 can be penetrated. For example, in the embodiment of FIGS. 1 and 2, actuation of the sleeve 18 not only performs a primary function of the assembly, e.g., selectively opening the ports 14, but also causes the restriction 22 to be exposed to the downhole fluids. Specifically, the passage 24 in the tubular 12 widens downhole for forming a cavity 38 between the sleeve 18 and the tubular 12 when the sleeve 18 is in its open position. Together with the channel 32, the cavity 38 enables fluid communication between the passage 24 and the unprotected area 30 of the core 26. Thus, by providing the proper fluid in the passage 24, degradation of the core 26 can commence immediately after actuation of the sleeve 18.

Figure 3:
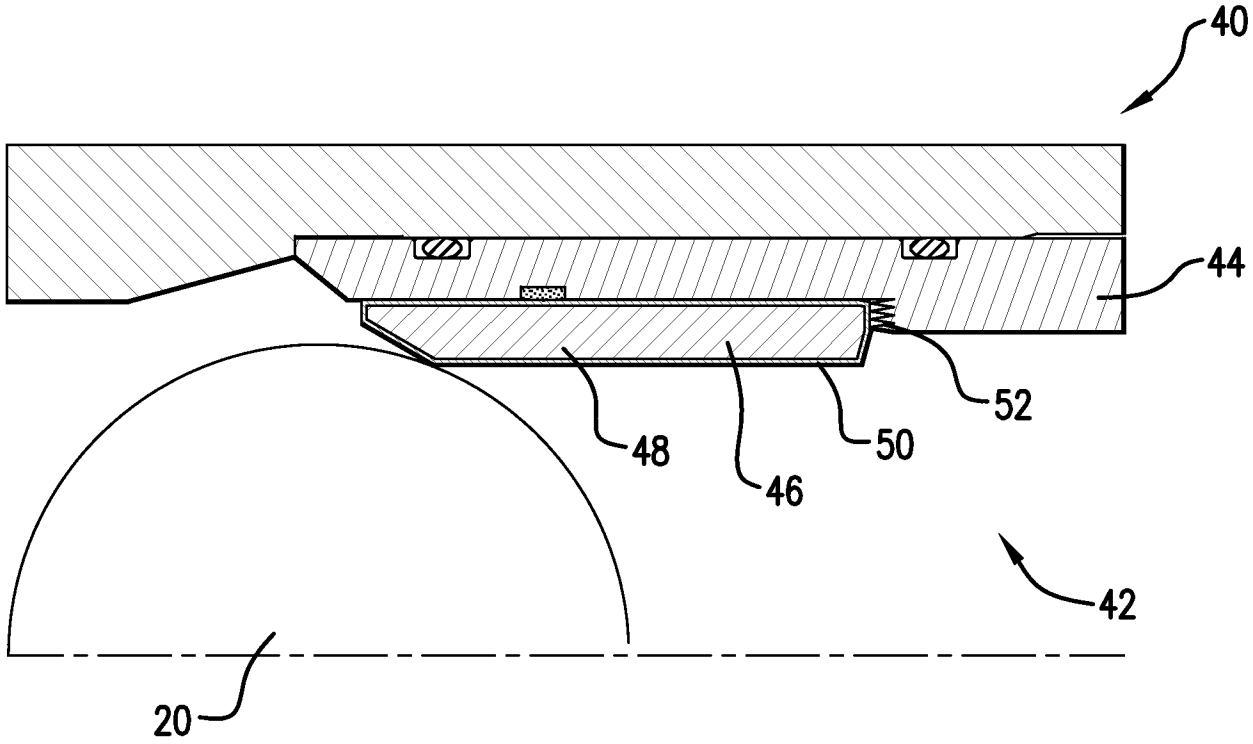
FIG. 3 is a quarter-sectional view of another downhole system having an actuatable plug assembly with a degradable seat.
Figure 4:
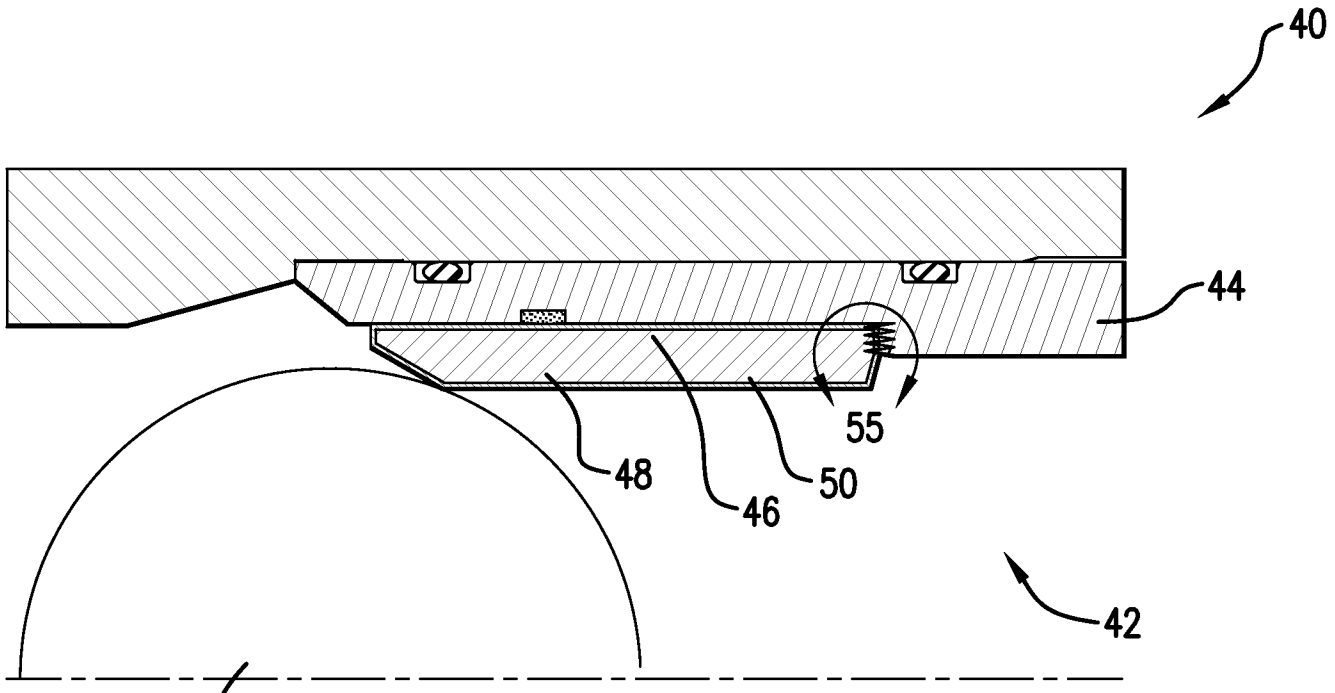
FIG. 4 is a quarter-sectional view of the system of FIG. 3 with a pressure applied to the plug assembly for exposing a degradable core of the seat to a downhole fluid.

A system 40 is shown in FIGS. 3 and 4 having an assembly 42 in an initial position and after a pressure is applied thereto, respectively. The assembly 42 generally resembles the assembly 16 in that it includes a sleeve 44 and a restriction 46, with the restriction 46 formed from a degradable core 48 and a protective layer 50. However, unlike the system 10, the protective layer 50 fully encloses the core 48. Instead of channeling fluid into an unprotected area of the core, actuation of the assembly 42 causes the layer 50 to be penetrated.

Figure 5:
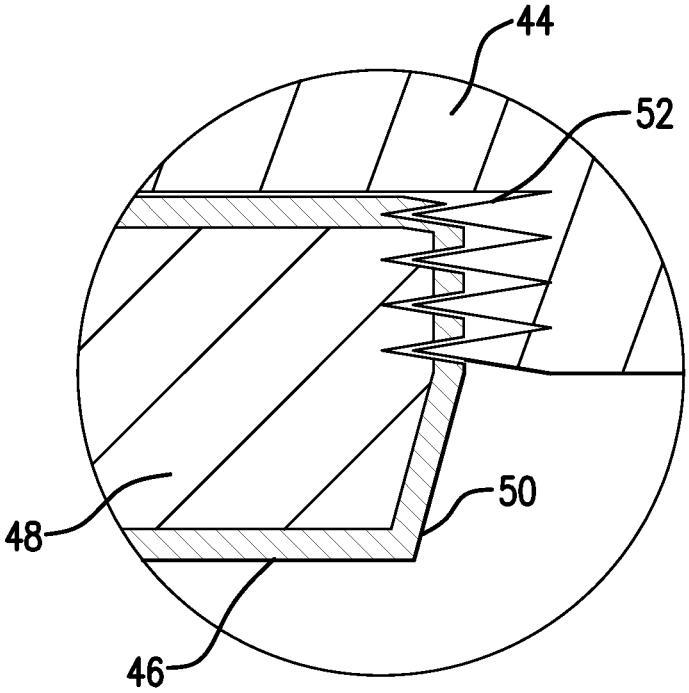
FIG. 5 is an enlarged view of the area generally encircled in FIG. 4 showing a protective layer penetrated in order to expose the core to the downhole fluid.

For example, in addition to performing some primary task or operation (e.g., opening ports, triggering a tool, etc.), actuation of the assembly 42 also drives the restriction 46 into a plurality of penetrating elements 52 on the sleeve 44. The penetrating elements 52 could be any features that penetrate, puncture, pierce, enter, or otherwise provide fluid access through the layer 50 to the core 48. The penetration of the layer 50 is shown in more detail in FIG. 5. The penetrating elements could take the form of sharp points, teeth, spikes, etc. The penetrating elements 52 could also include fins, blades, points, protrusions, abrasive or rough textures, etc., arranged on the circumferential surface of the sleeve 44 or the exterior of the restrictor 20, particularly if the restrictor 20 takes the form of an element that passes through or by the restriction instead of landing at the restriction, for scouring, etching, or abrading the layer 50 as the restriction 46 is actuated. Once the layer 50 is penetrated, the core 48 is exposable to downhole fluids for effecting removal of the restriction 46. In view of this embodiment it is to be appreciated that by positioning ports or the like radially outwardly from the restriction, making the restriction slidable directly against the tubular, and including the penetrating elements on the tubular, sleeves such as the sleeve 44 can be avoided, with the ports opening upon degradation of the restriction.

Figure 6:
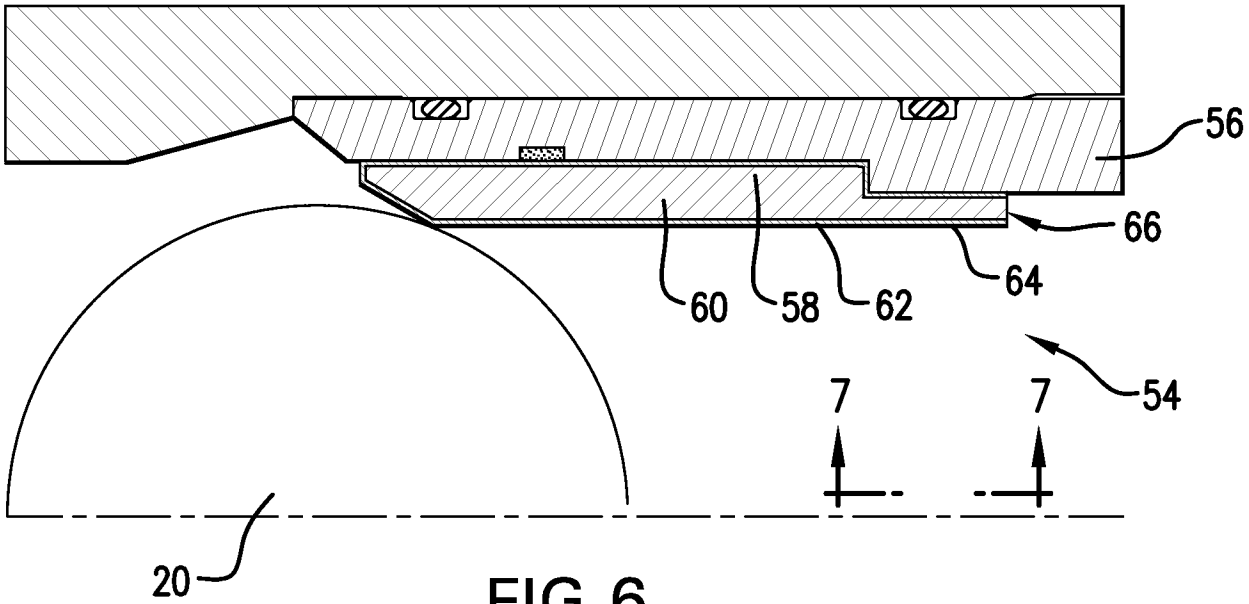
FIG. 6 is a quarter-sectional view of a downhole assembly having an extension for delaying degradation of a restriction.
Figure 7:
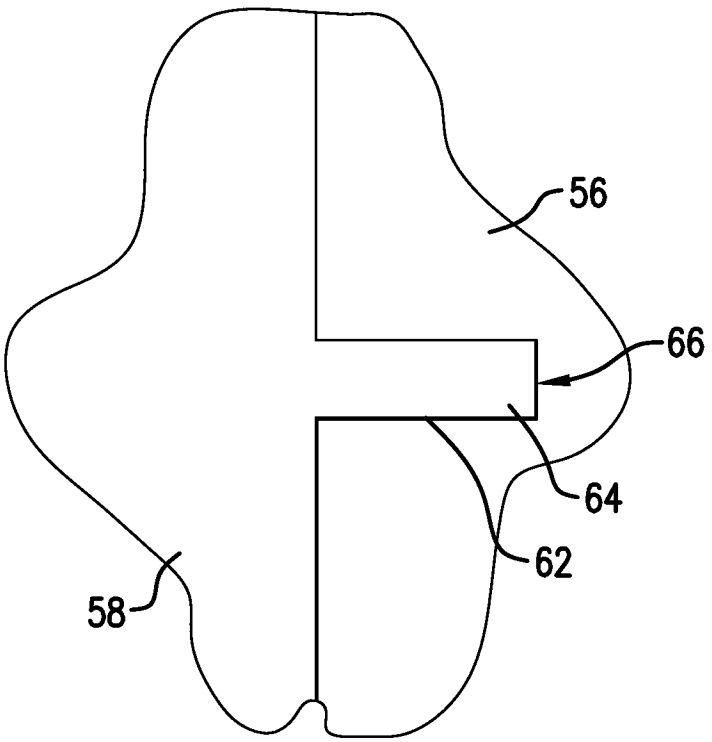
FIG. 7 is a view of the assembly taken generally along line 7-7 in FIG. 6.

Another embodiment is shown in FIGS. 6 and 7, namely including an assembly 54. The assembly 54 generally resembles the assemblies discussed above, having a sleeve 56 and a restriction or seat 58. Also similar to the above, the restriction 58 comprises a degradable core 60 and a protective layer 62. In the assembly 54, however, the restriction 58 has an extension 64 protruding axially therefrom. The extension 64 is coated by the layer 62 except for an uncovered area 66 at an end thereof. By distancing the uncovered area 66 from the main body of the restriction 58, the extension 64 acts as a "fuse" for delaying degradation of the restriction 58 until the extension 64 has fully degraded upon exposure of the uncovered area 66 to the downhole fluid. In this way, the length of the extension 64 can be set to delay degradation of the restriction 58 long enough for the restriction 58 to be first used for its primary purpose, e.g., receiving the restrictor 20 or some other plug for opening ports, etc., and then degrading thereafter.

Materials appropriate for the purpose of degradable restriction cores include magnesium, aluminum, controlled electrolytic metallic materials, etc. The controlled electrolytic materials as described herein are lightweight, high-strength metallic materials. Examples of suitable materials and their methods of manufacture are given in United States Patent Publication No. 2011/0135953 (Xu, et al.), which Patent Publication is hereby incorporated by reference in its entirety. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications. Suitable core materials include electrochemically active metals having a standard oxidation potential greater than or equal to that of Zn, including as Mg, Al, Mn or Zn or alloys or combinations thereof. For example, tertiary Mg—Al—X alloys may include, by weight, up to about 85% Mg, up to about 15% Al and up to about 5% X, where X is another material. The core material may also include a rare earth element such as Sc, Y, La, Ce, Pr, Nd or Er, or a combination of rare earth elements. In other embodiments, the materials could include other metals having a standard oxidation potential less than that of Zn. Also, suitable non-metallic materials include ceramics, glasses (e.g., hollow glass microspheres), carbon, or a combination thereof. In one embodiment, the material has a substantially uniform average thickness between dispersed particles of about 50 nm to about 5000 nm. In one embodiment, the coating layers are formed from Al, Ni, W or $Al_2O_3$, or combinations thereof. In one embodiment, the coating is a multi-layer coating, for example, comprising a first Al layer, an $Al_2O_3$ layer, and a second Al layer. In some embodiments, the coating may have a thickness of about 25 nm to about 2500 nm.

These powder compacts provide a unique and advantageous combination of mechanical strength properties, such as compression and shear strength, low density and selectable and controllable corrosion properties, particularly rapid and controlled dissolution in various borehole fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An actuation system comprising:

a tubular having a passage; and an assembly disposed with the tubular, the assembly including a degradable restriction, the restriction only partially blocking the passage prior to being degraded, the degradable restriction forming a seat configured to receive a restrictor thereon to block fluid flow through the passage, the assembly configured to be actuated by creating a pressure differential across the restrictor to shift the degradable restriction and the restrictor seated thereon longitudinally with respect to the tubular prior to the restriction being degraded, and the assembly further configured to release the restrictor when the restriction is degraded.

2. The system of claim 1, further comprising a protective layer on a degradable material of the restriction, the degradable material degrading upon exposure to a fluid in the passage and the protective layer isolating the degradable material from the fluid, wherein the degradable material includes an uncovered area with respect to the protective layer.

3. The system of claim 2, wherein at least one seal element is included to isolate the uncovered area from the fluid.

4. The system of claim 2, wherein actuation of the assembly establishes fluid communication between the uncovered area and the passage.

5. The system of claim 4, wherein fluid communication between the uncovered area and the passage is enabled by a cavity in the tubular, the cavity misaligned with the uncovered area before actuation.

6. The system of claim 2, wherein the seat is formed at an uphole end of the restriction and the uncovered area is limited to a downhole end of the restriction.

7. The system of claim 1, wherein actuation of the assembly opens at least one port in the tubular.

8. The system of claim 7, wherein the assembly includes a sleeve disposed radially between the restriction and the tubular and actuation of the assembly shifts the sleeve to open the at least one port.

9. The system of claim 1, wherein a degradable material of the restriction is entirely encapsulated by a protective layer, the degradable material degrading upon exposure to a fluid in the passage and the protective layer isolating the degradable material from the fluid.

10. The system of claim 1, further comprising a protective layer on a degradable material of the restriction, the degradable material degrading upon exposure to a fluid in the passage and the protective layer isolating the degradable material from the fluid, wherein actuation of the assembly causes at least one penetration element to penetrate the protective layer for exposing the degradable material to the fluid.

11. The system of claim 1, wherein a degradable material of the degradable restriction is a controlled electrolytic metallic material.

12. An actuation system comprising:

a tubular having a passage; and an assembly disposed with the tubular, the assembly including a degradable restriction, the restriction only partially blocking the passage prior to being degraded, a protective layer on a degradable material of the restriction, the degradable material degrading upon exposure to a fluid in the passage and the protective layer isolating the degradable material from the fluid, wherein the degradable material includes an uncovered area with respect to the protective layer, the assembly configured to receive and prevent further movement of a restrictor through the tubular prior to the restriction being degraded, the assembly further configured to release the restrictor when the restriction is degraded;

wherein the uncovered area is located on an extension from the restriction, the extension operatively arranged to delay degradation of the restriction until the extension is first degraded.

13. A method of operating the downhole system of claim 1, comprising:

launching the restrictor through the passage in the tubular;

receiving the restrictor at the restriction of the assembly; and, actuating the assembly with the restrictor for performing a primary function of the assembly.

14. The method of claim 13, wherein the primary function of the assembly is to selectively open at least one port in the tubular.

15. The method of claim 13, wherein actuating the assembly aligns an uncovered area of the degradable material with a cavity in the tubular, the cavity establishing fluid communication between the uncovered area and the passage.

16. The method of claim 13, wherein the degradable material is entirely encapsulated by the protective layer and actuation of the assembly causes at least one penetrating element to penetrate the protective layer for exposing the degradable material to the fluid.

17. An actuation system, comprising:

a tubular defining a passage; and an assembly disposed within the tubular, the assembly having a restriction operatively arranged for receiving a restrictor, the restrictor enabling actuation of the assembly, the restriction at least partially formed from a degradable material responsive to a fluid in the passage, a protective layer disposed on the degradable material, the degradable material including an uncovered area with respect to the protective layer, the uncovered area located on an extension from the restriction, wherein actuating the assembly performs a primary function, the extension operatively arranged to delay degradation of the restriction until the extension is first degraded.

18. The actuation system of claim 17, wherein the extension extends longitudinally from the restriction, and the extension is coated by the protective layer except for the uncovered area.

19. The system of claim 17, wherein the extension extends from a main body of the restriction, the extension having a smaller radial thickness than the main body.

20. The system of claim 17, wherein the restriction includes a seat configured to receive the restrictor at an uphole end of the restriction, and the uncovered area is limited to a downhole end of the restriction.

* * * * *